US006607097B2

(12) United States Patent
Savage et al.

(10) Patent No.: US 6,607,097 B2
(45) Date of Patent: Aug. 19, 2003

(54) COLLAPSIBLE BAG FOR DISPENSING LIQUIDS AND METHOD

(75) Inventors: Chester Savage, Irvine, CA (US); Kenneth Micnerski, Downers Grove, IL (US); Richard Carroll, Tustin, CA (US); Nancy Lu, Irvine, CA (US); Richard L. Albiani, Westchester, IL (US); Rocklin Verespej, San Clemente, CA (US)

(73) Assignee: Scholle Corporation, Irvine, CA (US)

( * ) Notice: Subject to any disclaimer, the term of this patent is extended or adjusted under 35 U.S.C. 154(b) by 0 days.

(21) Appl. No.: 10/108,117

(22) Filed: Mar. 25, 2002

(65) Prior Publication Data

US 2002/0148857 A1 Oct. 17, 2002

Related U.S. Application Data

(63) Continuation of application No. 09/709,144, filed on Nov. 10, 2000, now abandoned.
(60) Provisional application No. 60/164,699, filed on Nov. 10, 1999.

(51) Int. Cl.[7] ..... B67B 7/00; B65D 35/08
(52) U.S. Cl. ..... 222/1; 222/107; 222/566; 220/62.12
(58) Field of Search ..... 222/1, 92, 107, 222/544, 566; 220/495.01, 62.11, 62.12, 62.18, 62.19

(56) References Cited

U.S. PATENT DOCUMENTS

| | | | | |
|---|---|---|---|---|
| 3,595,722 A | | 7/1971 | Dawbarn | |
| 3,857,144 A | * | 12/1974 | Bustin | 156/199 |
| 4,286,636 A | | 9/1981 | Credle | |
| 4,601,410 A | | 7/1986 | Bond | |
| 4,964,540 A | | 10/1990 | Katz | |
| RE34,929 E | | 5/1995 | Kristen | |
| 5,497,911 A | | 3/1996 | Ellion et al. | |
| 5,549,944 A | | 8/1996 | Abate | |
| 5,554,423 A | | 9/1996 | Abate | |
| 5,566,851 A | | 10/1996 | Sasaki et al. | |
| 5,639,523 A | | 6/1997 | Ellis | |
| 5,647,511 A | | 7/1997 | Bond | |
| 5,721,392 A | * | 2/1998 | Chan et al. | 102/275.1 |
| 5,728,446 A | | 3/1998 | Johnston et al. | |
| 5,743,435 A | * | 4/1998 | Tomic | 348/443 |
| 5,749,493 A | | 5/1998 | Boone et al. | |
| 5,827,164 A | | 10/1998 | Tomic | |
| 5,897,930 A | | 4/1999 | Calhoun et al. | |
| 5,915,596 A | | 6/1999 | Credle, Jr. | |
| 5,941,421 A | | 8/1999 | Overman et al. | |
| 6,136,414 A | | 10/2000 | Aizawa et al. | |

FOREIGN PATENT DOCUMENTS

WO WO 99/46169 9/1999

OTHER PUBLICATIONS

Brochure from Dow Chemical Company Entitled "High Release Separator Film" "LDF 211" Low Density Polyethylene Film, published Aug. 1999.

* cited by examiner

*Primary Examiner*—Ehud Gartenberg
*Assistant Examiner*—Patrick Buechner
(74) *Attorney, Agent, or Firm*—King & Jovanovic, PLC

(57) ABSTRACT

A collapsible bag for dispensing liquids which includes at least one sheet sealed to define an enclosure and a fitment (spout) attached to the enclosure and out through which liquid in the enclosure is dispensed. An interior surface of the one or more sheets has integral texture to assist in withdrawal of the liquid from the enclosure when collapsed. The texture can be provided by sheet surfaces that are mechanically or ultrasonically embossed or are bubble-cushioned or which have sealed pleats or accordion folds. The bottom surface of a lower flange of the fitment may have concentric ridges (or spirals) and/or radial grooves. Also disclosed are methods of making the bag from one, two, three or four sheets.

7 Claims, 26 Drawing Sheets

COLLAPSIBLE BAG FOR DISPENSING LIQUIDS AND METHOD

CROSS-REFERENCE TO RELATED APPLICATIONS

This application is a continuing application and claims the filing date benefit of application Ser. No. 09/709,144, filed Nov. 10, 2000, now abandoned, which claims the benefit of U.S. Provisional Application No. 60/164,699, filed Nov. 10, 1999, the contents of which are hereby incorporation by reference.

FIELD OF THE INVENTION

The present invention relates to collapsible bags for dispensing liquid products, and more particularly to collapsible bags having a surface that provides guiding or capillary paths for dispensing liquid products.

BACKGROUND OF THE INVENTION

Various collapsible bags or containers are known in the prior art which are adapted to be filled with liquid contents and sealed and which allow their liquid contents to be suction withdrawn through their annular spouts or fitments. The walls of the bag are typically sheets of plastic, which are typically formed of polyethylene, polypropylene, nylon, or polyester. The liquid contents can be juices, milk, drink syrups or other liquids such as photoprocessing solutions, cleaning chemicals, or cocktail mixes. An example of these collapsible bags is the so-called "bag-in-box" commonly used in the soft drink industry to deliver the drink syrup to the dispensing machine. The bags are fed into filling machines which uncap them, fill them with the syrup (or other liquid), recap them and box them. The boxes structurally support the bags during storage, shipment, and as they are being emptied. The bags are emptied through a spout in the bag accessible through a hole in the box and using a pump.

A plastic dip tube or dip strip disposed in the bag and secured therein so as to pass over the spout opening or to be secured to the spout opening assists in the withdrawal of the syrup from the bag. The strip prevents the bag from collapsing on the opening and closing it, and also guides the remaining quantities of syrup in the bag to the opening as the syrup continues to be withdrawn. The strip can be attached to the spout and/or to the inside wall of the plastic bag. Alternatively, the dip tube or dip strip can be attached to the perimeter seal of the bag. Examples of dip tubes or dip strips and their collapsible bags are shown in U.S. Pat. No. 4,286,636 (Credle), U.S. Pat. No. 4,601,410 (Bond), U.S. Pat. No. 5,647,511 (Bond), U.S. Pat. No. 5,915,596 (Credle), and U.S. Pat. No. 5,941,421 (Overman et al.) and in WO 99/46169 (Coca-Cola Company). (All of the patents and other publications mentioned anywhere in this disclosure are hereby incorporated by reference in their entireties.)

In addition to the separate manufacturing step required to make the dip tube or dip strip and the attendant material required to make the dip tube or dip strip, the application to the bag of a dip tube or dip strip requires yet another separate manufacturing step. Generally, after the spout is secured to the bag, the dip tube or dip strip is disposed in the bag by attachment to the spout, the inside wall of the bag or to the perimeter seal of the bag, or a combination of the above. This adds to the manufacturing time and expense. A further disadvantage of the strips, in addition to the cost of manufacturing them, is that they may become dislodged when the bag is filled at high pressure. A still further disadvantage of the strips is that they may create a back pressure and reduce fill rates.

SUMMARY OF THE INVENTION

Accordingly, disclosed herein is an improved collapsible bag which does not have a dip strip or dip tube and the problems associated therewith. Rather, the bag sheets have a unique construction which aids in the complete or near complete withdrawal of the syrup or other contained liquid. The sheets themselves have a surface "texture," which provides a guiding or capillary path for draining the liquid out the spout and which also prevents the sheets from closing off the flow to the spout during the suction of the pump.

One example of the textured surface is an embossed sheet of film with raised work in multiple designs and which can be mechanically embossed or ultrasonically embossed. Ultrasonic welding displaces a pattern into the surface of the film, thereby replicating a mechanically embossed ("waffle-like" or other) pattern. The plastic sheets which comprise the walls of the bag can both be embossed or just one can be embossed. The sheets may be comprised of more than one layer of film, manufactured through co-extrusion or lamination. Other examples of "textured" surfaces which can be used are bubble wraps (cushion packaging), sealed pleats and folded constructions which run towards the spout. Further examples are disclosed in U.S. Pat. No. 4,964,540 (Katz), U.S. Pat. No. 5,549,944 (Abate) and U.S. Pat. No. 5,554,423 (Abate).

Also disclosed herein is an improved collapsible bag fitment. The bottom surface of the lower seal flange of the fitment preferably has seven concentric ridges or rings, twelve evenly spaced radial channels or grooves, and twelve gussets at the edge of the spout opening. An advantage to having radial grooves in conjunction with the concentric rings is the additional capillary or flow channel capacity created by using the full surface area of the flange.

An alternative embodiment changes the concentric rings to one or more spiral grooves to increase the flow to the spout bore using the same principle. In conjunction either with the radial grooves, concentric rings and gussets or with the spiral groove design or with the waffle pattern design, other features may be incorporated to enhance evacuation, including grooves on the inside bore of the spout and cross-bars spanning the spout opening.

Other objects and advantages of the present invention will become more apparent to those persons having ordinary skill in the art to which the present invention pertains from the foregoing description taken in conjunction with the accompanying drawings.

DETAILED DESCRIPTION OF PREFERRED EMBODIMENTS OF THE INVENTION

Figure 1:
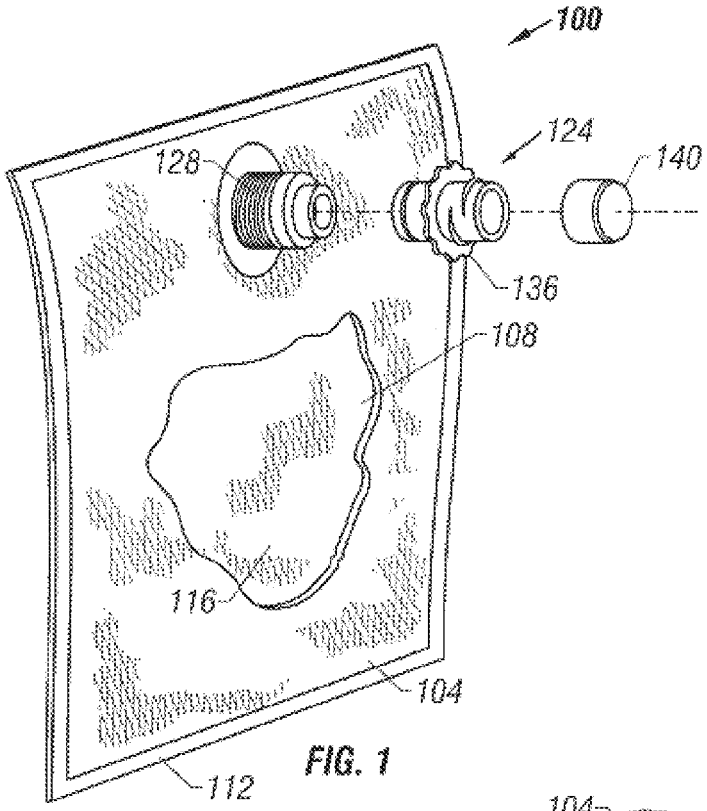
FIG. 1 is a perspective view of a collapsible bag of the present invention with the fitment components shown in exploded relation and a portion of the plastic sheet comprising one of the bag walls broken away for illustrative purposes.

A collapsible bag of the present invention is illustrated generally at 100 in FIG. 1. Bag 100 includes two preferably rectangular sheets of plastic 104, 108 which comprise the two walls secured together about their perimeters 112 to define therebetween an enclosed region 116 for containing the liquid product, such as the drink syrup and other liquids previously mentioned. The sheets 104, 108 are secured together by heat sealing, impulsed sealing, radio frequency (RF) sealing, or other techniques as would be apparent to those skilled in the art. For a five gallon bag, the sheets 104, 108 would preferably have dimensions of 18¼ inches by 22¼ inches.

The sheet 104 has a through-hole and a fitment shown generally at 124 secured at the hole. The fitment 124 has three parts: a spout member 128 having a lower flange 132, a valve member 136 having a check valve therein and a cap 140. All three parts can be made of plastic, preferably polyethylene.

Figure 2A:
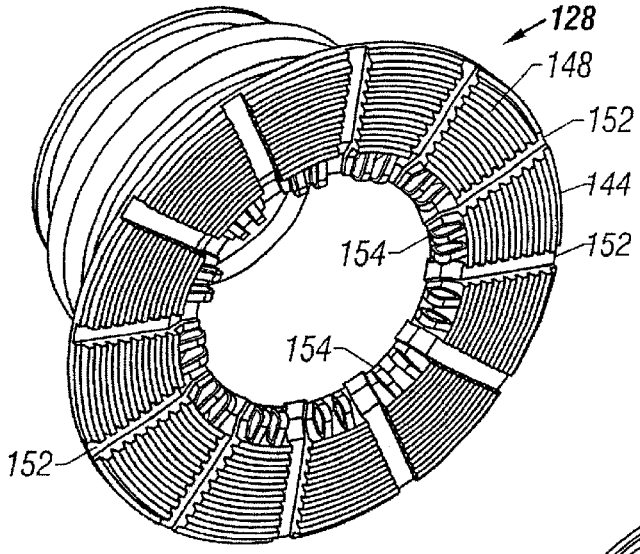
FIGS. 2*a* and 2*b* are enlarged views of a bottom surface of a lower flange of the fitment.
Figure 2B:
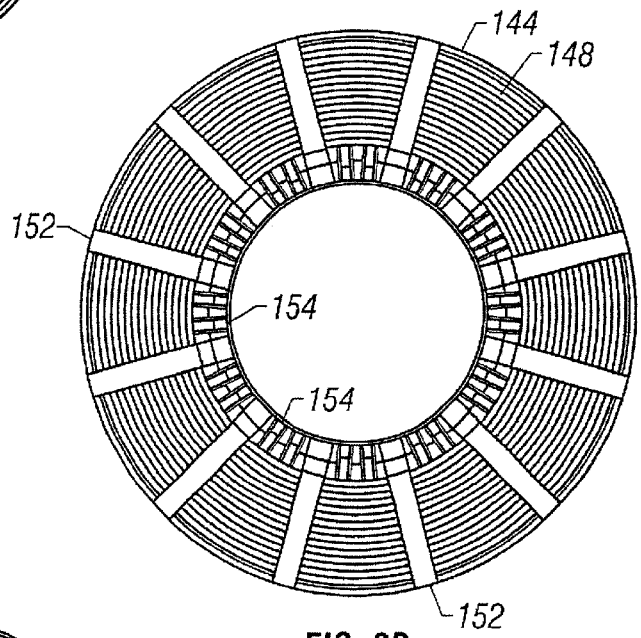

The bottom surface 144 of the lower flange 132 is shown enlarged and in isolation in FIGS. 2*a* and 2*b*. Referring thereto it is seen to have concentric ridges 148, radial grooves 152, and gussets 154, whose functions are described later.

Figure 3:
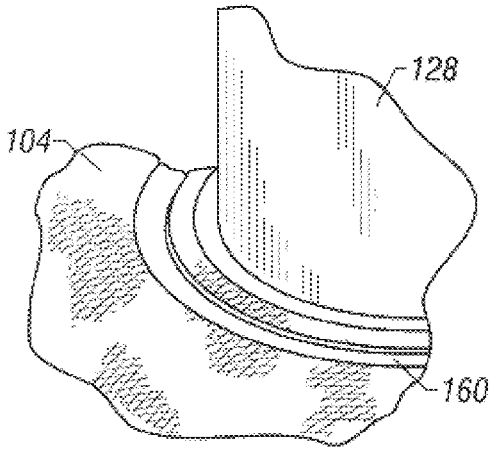
FIG. 3 is an enlarged perspective view showing the securement of the plastic sheet to the top surface of the bottom seal flange of the fitment.
Figure 4:
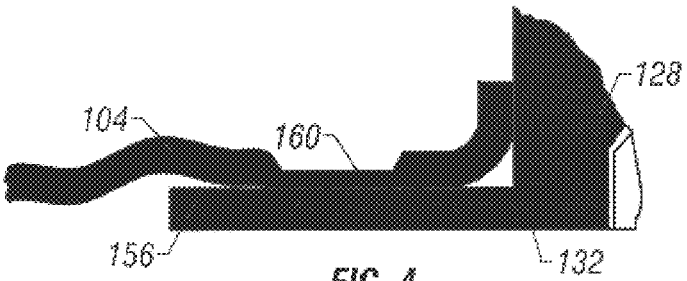
FIG. 4 is a cross-sectional view through FIG. 3.

The spout member 128 is passed through the through-hole so that the top surface 156 of the lower flange 132 engages the bottom surface of the sheet 104, as shown in FIGS. 3 and 4. The sheet 104 is secured to the flange top surface 156 as a ring-shaped seal 160 around the lower flange 132. Thus, the flange top surface 156 acts as a sealing surface. It is secured preferably by heat sealing, impulsed sealing or RF sealing.

The bag 100 can be formed by providing a first roll of material to form the sheet 104 and a second roll of material to define the sheet 108, unwinding a portion of the first roll, punching a hole in the unwound portion to define the through-hole, fitting the spout member 128 up through the through-hole, and sealing the lower flange 132 to the unwound portion to form the seal ring 160. A portion of the second roll is unwound and the portions of the two rolls are sealed together about their perimeters 112 to define the enclosure 116.

At the filling station the valve member 136 and cap 140 are removed from the spout member 128, and the enclosure 116 is filled through the opening in the spout member 128 with the liquid product. The valve member 136 and cap 140 are then reattached to the spout member 128. The filled bag is boxed in a box (not shown) having a perforated area that can be opened, allowing access to the fitment. The customer then, with the filled bag in the box, accesses the fitment 124 through the box opening, removes the cap 140 and attaches the suction hose (not shown) to the fitment 124. The suction hose is operatively connected to a suction pump (also not shown) and the liquid is withdrawn through the fitment 124 or spout as desired by the customer. The check valve 136 allows the liquid to be sucked out of the bag 100 but seals the bag, preventing air from entering the bag 100.

A further alternative is to dispense liquid through the fitment but fill the bag through another opening which is subsequently sealed closed.

Figure 2C:
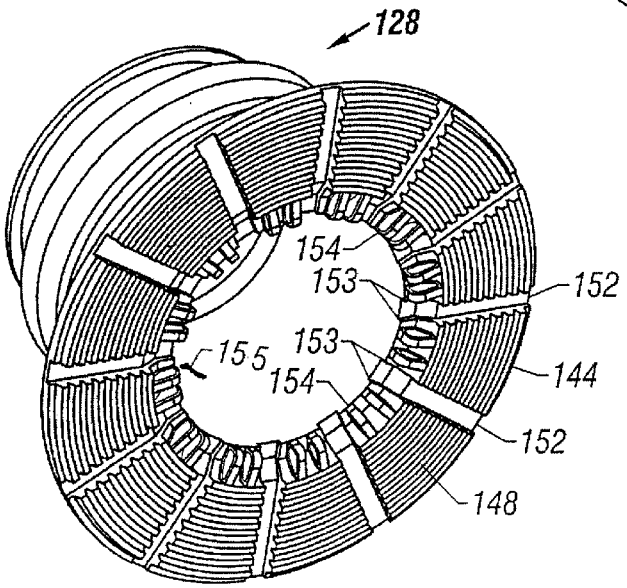
FIG. 2*c* is an alternative embodiment of a bottom surface of a lower flange of the fitment.

Pursuant to the present invention, the sheets 104, 108 have a unique construction which prevents the bag 100 from being sucked into the spout member 128 and thereby blocking further draining, and which channels the liquid into the spout member 128 thereby assisting in essentially complete draining of the bag 100. The radial grooves 152, concentric ridges 148, and gussets 154 in the lower flange 132 also help channel the liquid and help prevent the bag 100 from being sucked in. An advantage of providing concentric ridges 148 and gussets 154 along with the radical grooves 152 is that channels are defined for the liquid (syrup) to travel through the radial flange 132. In contrast, with only radial grooves, there are still flat surfaces between the radial grooves allowing for possible film blockage of the bag or reduced flow rate. This unique sheet construction can include interior surfaces of the first and second sheets 104, 108 having "textured" surfaces which define liquid drainage channels. FIG. 2*c* illustrates an alternative embodiment 128.

One "textured" surface embodiment of the invention is to have the sheets 104, 108 made of embossed material, such as that disclosed in U.S. Pat. Re. No. 34,929 (Kristen). This embossed sheet material can be a single layer, two layers, three layers or more layers of material. The layers can be co-extruded or glued or laminated together or less preferably separate and connected only at their edges by a perimeter seal. One or both of the sheets 104, 108 can have the embossed construction. In the construction where the layers are separate rather than being attached at their edges, only the inside layers are separate rather than being attached at their edges, only the inside layer, or that which make contact with the product contained in the bag, need be embossed. If the embossing is deep enough, the radial grooves 152, concentric ridges 148, and guests 154 or spirals may not be needed, and the bottom surface of the flange can then be smooth. Further, if the bag is oriented so that the spout is facing down (at the bottom of the bag), only the textured flange bottom may be required and the sheets need not be embossed.

Figure 5:
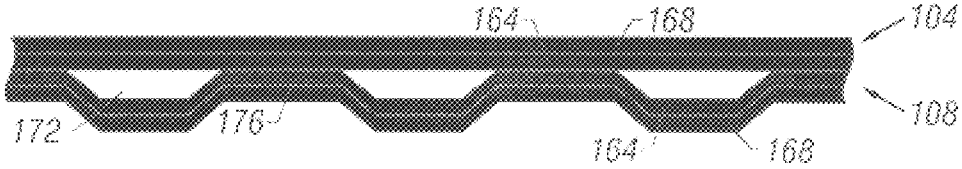
FIG. 5 is an enlarged cross-sectional view through a portion of an alternative collapsible bag of the present invention, showing a non-embossed sheet comprising one wall and an embossed sheet comprising the other wall.

FIG. 5 shows a bag construction in a collapsed state with the sheets 104, 108 contacting each other. In this embodiment, the sheet 108 (but not the sheet 104) has an embossed construction, and both sheets 104, 108 have a two-layer construction with the inner layer 164 being a polyethylene material and the outer layer 168 being a nylon material. As seen therein the spaces 172 between the "bumps" 176 of the embossed material define liquid draining channels therebetween.

Figure 6:
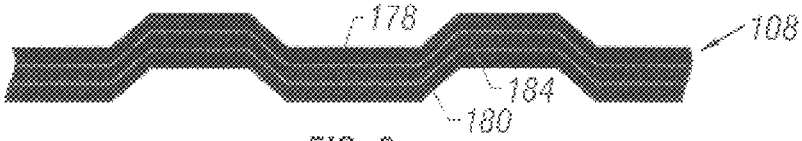
FIG. 6 is an enlarged cross-sectional view through an alternative three-layer embossed sheet of a bag of the present invention.
Figure 7:
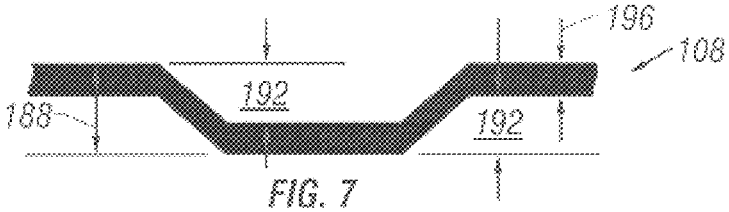
FIG. 7 is an enlarged view of an embossed sheet showing preferred dimensions.

FIG. 6 shows an enlarged cross-section portion of the sheet 108 (or sheet 104) of an alternative bag construction. As shown therein, the sheet has a three-ply laminate construction with top and bottom polyethylene layers 178, 180 and a center nylon layer 184. FIG. 7 shows dimensions 188, 192, 196 of an embossed (single layer or multiple-layer laminate) sheet 108 (or 104), which are in one embodiment 0.0075, 0.005, and 0.0025 inch, respectively.

Figure 8:
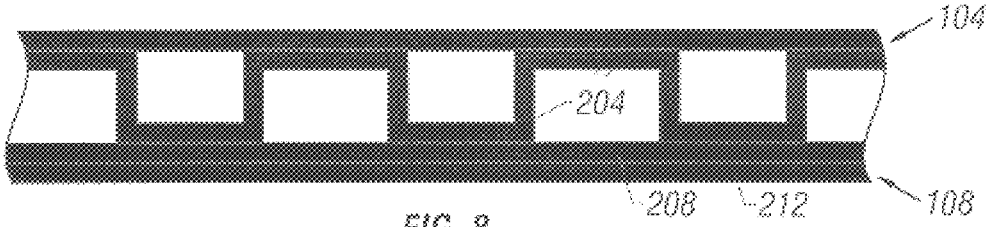
FIG. 8 is a view similar to FIG. 6 showing a bubble wrap or cushion layer embodiment of the present invention.
Figure 9:
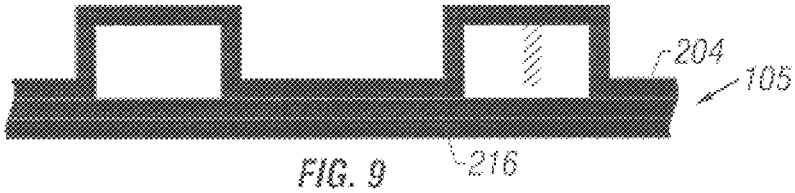
FIG. 9 is a view similar to FIG. 6 showing an alternative three-layer cushion sheet embodiment of the present invention.

Another bag construction of the present invention which provides the "textured" surface is for one or both of the sheets to include a cushion layer or specifically a blister or bubble wrap layer, such as the material used to provide cushioning for packaging items. The "bubbles" can have heights of 3/16 or 1/8 inch, for example. One embodiment is illustrated in FIG. 8 where only the sheet 104 is shown to include a bubble wrap layer 204, and the other sheet 108 comprises a conventional smooth polyethylene-nylon, two-layer construction 208, 212. However, the top sheet 104 would preferably be the smooth layer and the bottom sheet 108 would be the bubble wrap layer, and thereby the bottom layer would be less likely to be sucked into the fitment 124. The sheet 108 (or 104) can include a nylon sheet 216 laminated to the bubble wrap layer 204 as shown in FIG. 9.

Figure 10A:
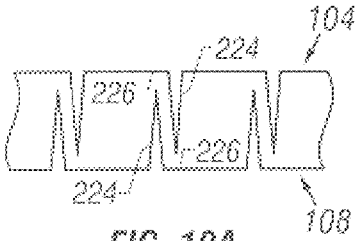
FIGS. 10*a*–10*c* are views showing a sealed pleated embodiment of the present invention.
Figure 11A:
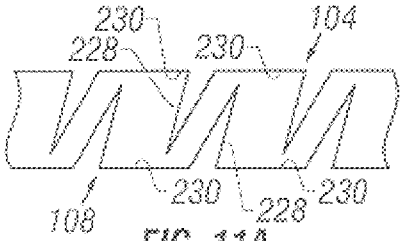
FIGS. 11*a*–11*c* are views showing an accordion fold embodiment of the present invention.
Figure 10B:
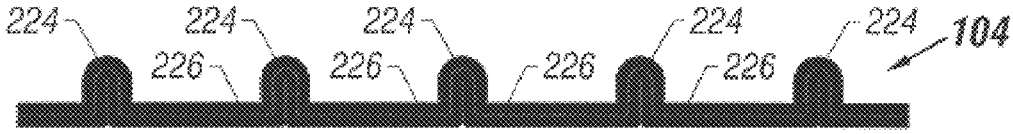
Figure 10C:
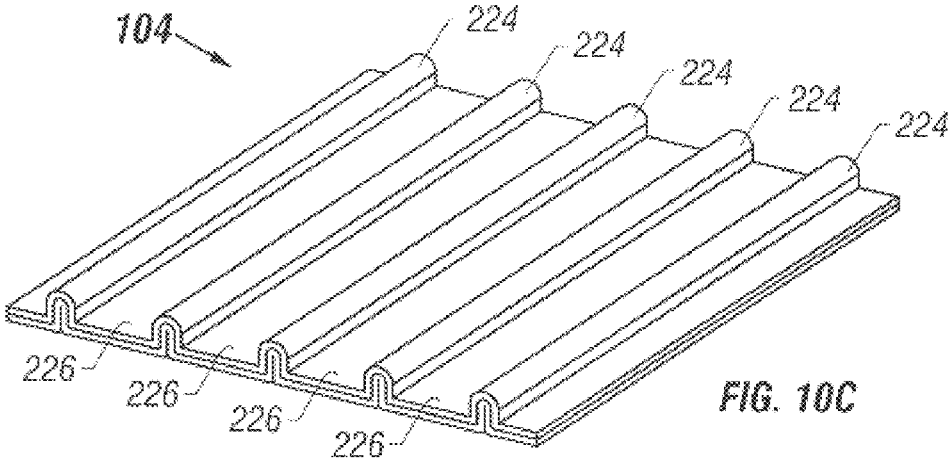
Figure 11B:
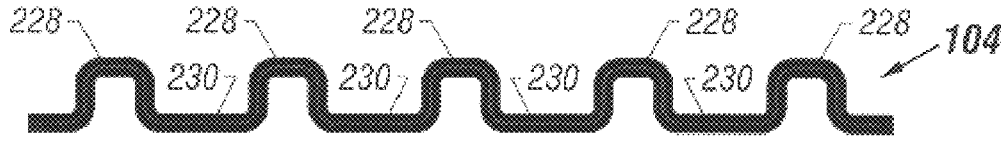
Figure 11C:
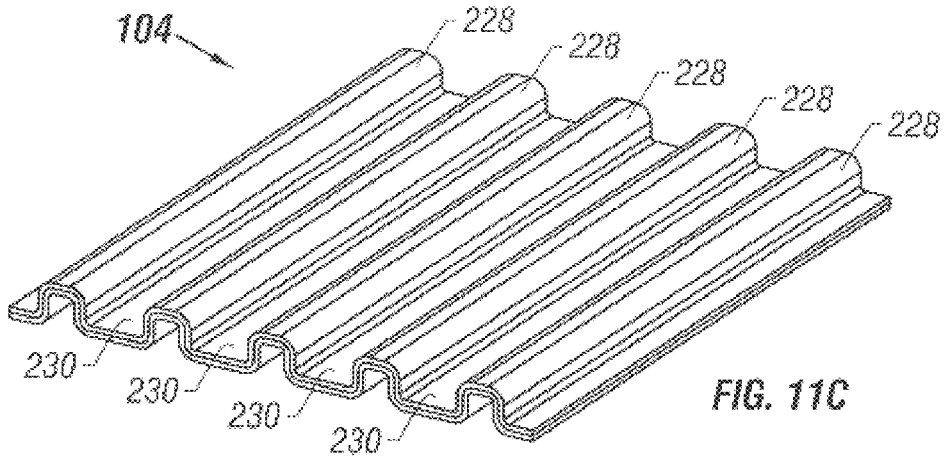

Alternative bag constructions are illustrated in FIGS. 10*a*–10*c* and 11*a*–11*c*. FIG. 10*a* shows both sheets 104, 108 having spaced, sealed pleats 224, defining channels 226 and "textured" interior bag surfaces. FIG. 10*b* shows how each of the sealed pleats 224 is sealed at its base, and FIG. 10*c* is a perspective view of the sheet 104 illustrating the sealed pleats 224 and channels 226. However, it is also within the scope of the invention for only one of the sheets to have the sealed pleats and the other being a conventional smooth construction. Furthermore, the sheets 104, 108 or sheet 104, 108 may include a single set of sealed pleats oriented in a parallel fashion and directed towards the spout member 128 or may include two sets of sealed pleats forming a "waffle-like" or other pattern. Instead of pleats, FIGS. 11*a*–11*c* show the sheet 104 having spaced folds 228 and channels 230 therebetween. Similarly, one of the sheets can have the folded construction and the other can have a non-folded construction.

Figure 12A:
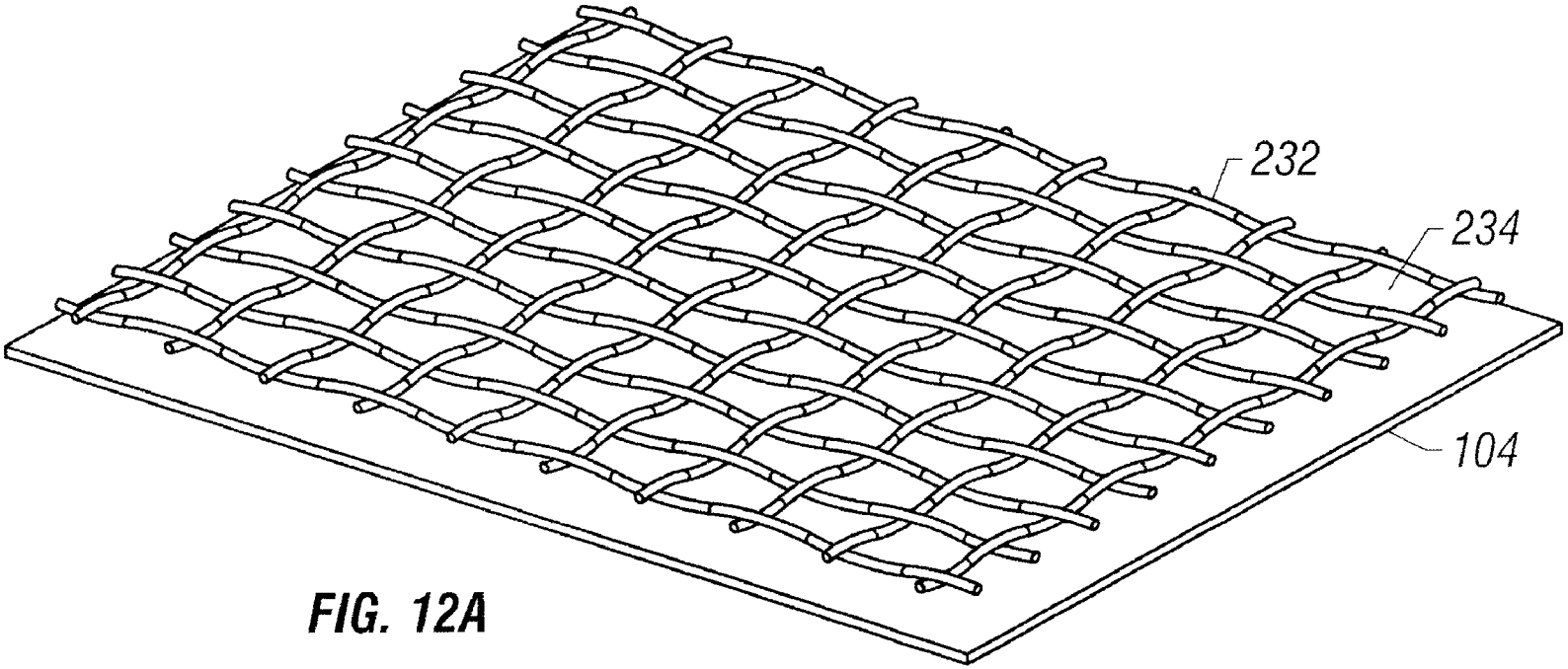
FIGS. 12*a*–12*c* are views showing a mesh layer embodiment of the present invention.
Figure 12B:
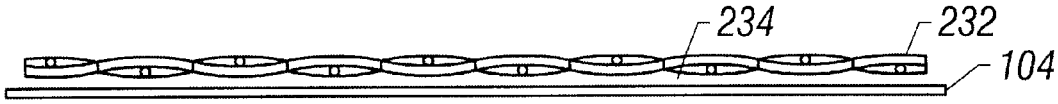
Figure 12C:
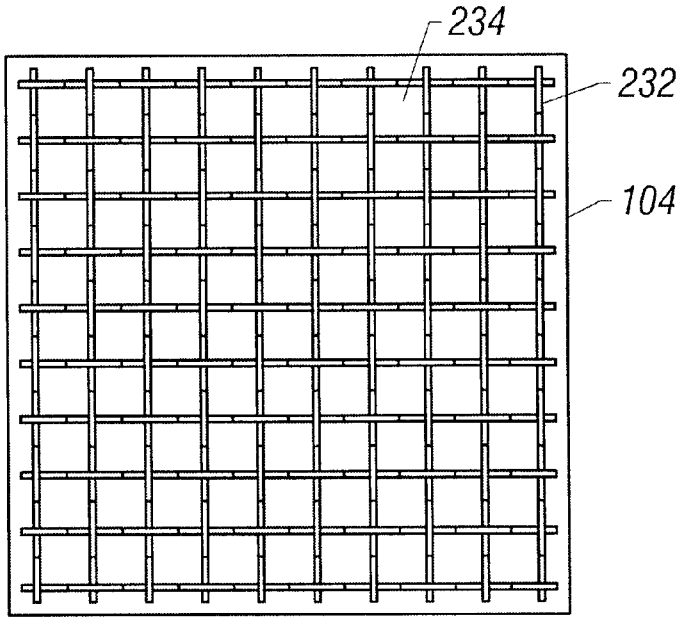
Figure 13A:
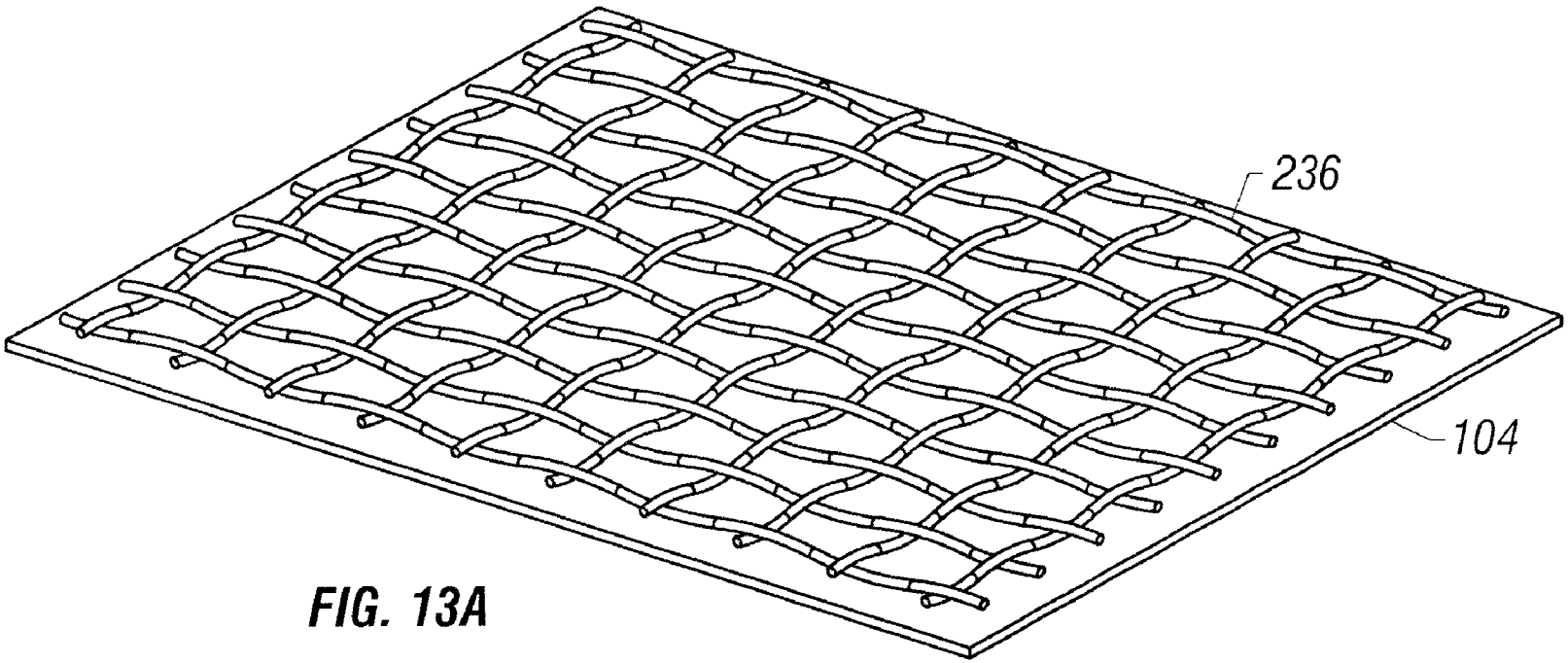
FIGS. 13*a*–13*c* are views showing another mesh layer embodiment of the present invention.
Figure 13B:
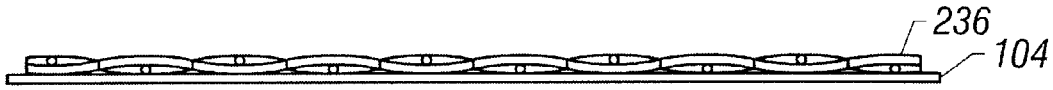
Figure 13C:
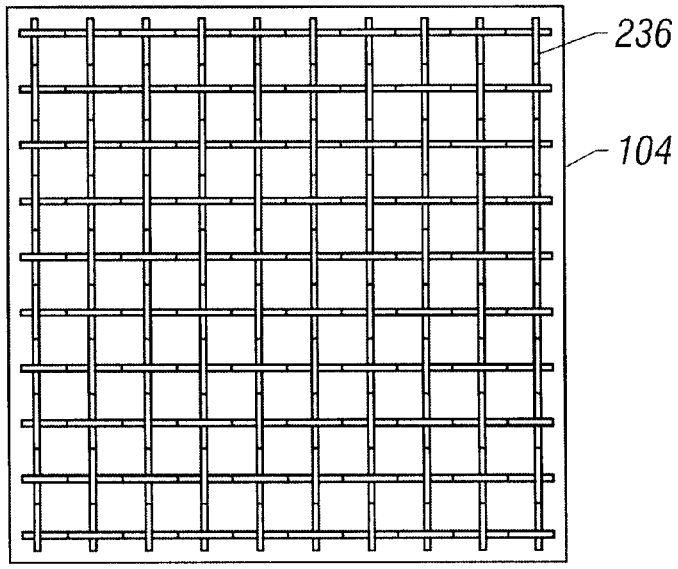
Figure 14A:
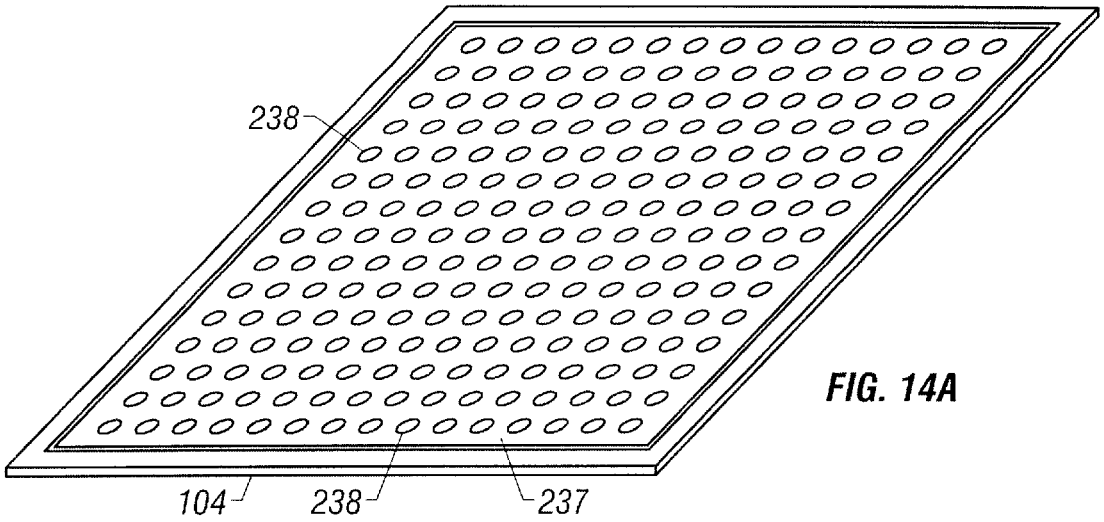
FIGS. 14*a*–14*c* are views showing a perforated sheet embodiment of the present invention.
Figure 14B:
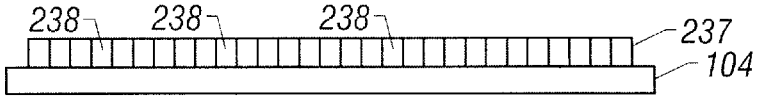
Figure 14C:
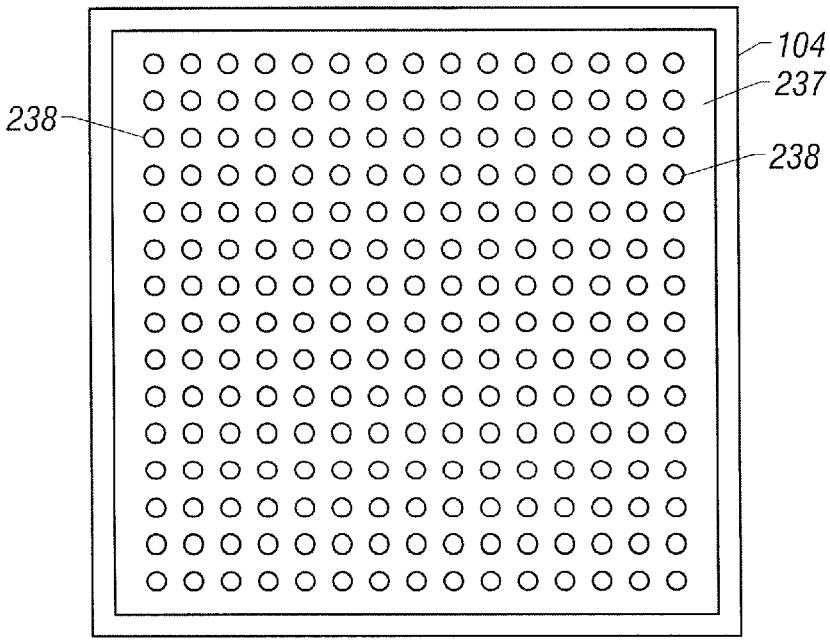

Still further alternative bag constructions are shown in FIGS. 12*a*–12*c*, FIGS. 13*a*–13*c*, and FIGS. 14*a*–14*c*. FIGS. 12*a*–12*c* show a bag construction in which a mesh layer 232 is disposed between the sheets 104, 108 to provide liquid draining channels 234. The mesh layer 232 and sheets 104, 108 are separate other than being attached about their perimeters. It is contemplated that the mesh layer 232 can be made of plastic such as polyethylene, nylon and the like. Instead of the mesh layer being separate from the sheets 104, 108, FIGS. 13*a*–13*c* illustrate a mesh layer 236 secured to one of the sheets 104, 108. The mesh layer 236 may be secured to one of the sheets 104, 108 by heat sealing, impulsed sealing, or RF sealing. FIGS. 14*a*–14*c* show a bag construction in which a perforated sheet 237 having a plurality of apertures 238 is disposed between the sheets 104, 108 to provide liquid draining channels. The perforated sheet 237 and sheets 104, 108 are separate other than being attached about their perimeters.

Alternative Fitment Body Members

Figure 15A:
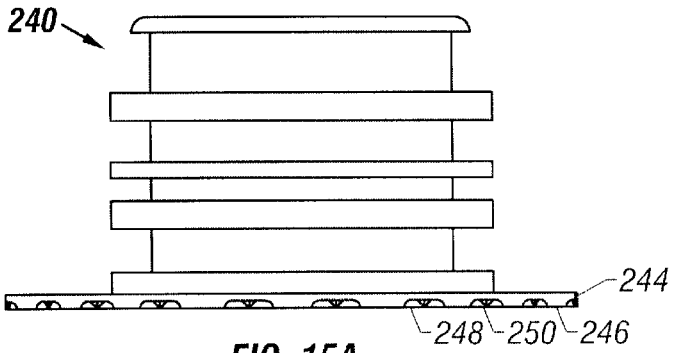
FIGS. 15*a*–15*c* are views illustrating an embodiment of a fitment body member having a "waffle" texture in accordance with the present invention.
Figure 15B:
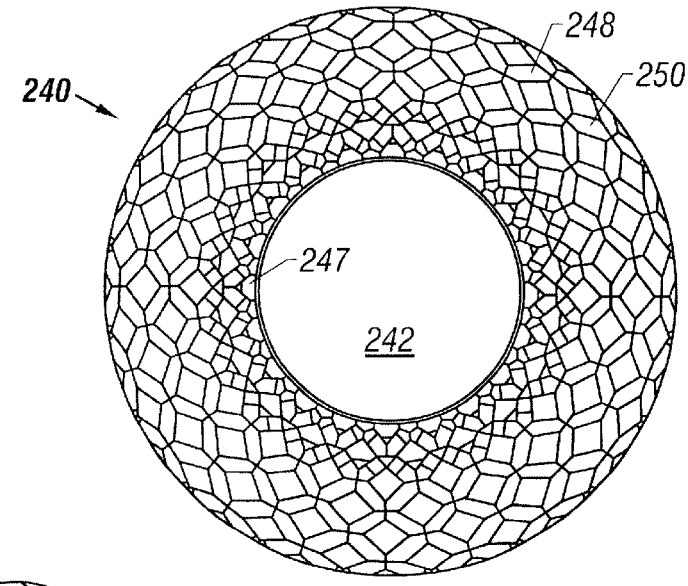
Figure 15C:
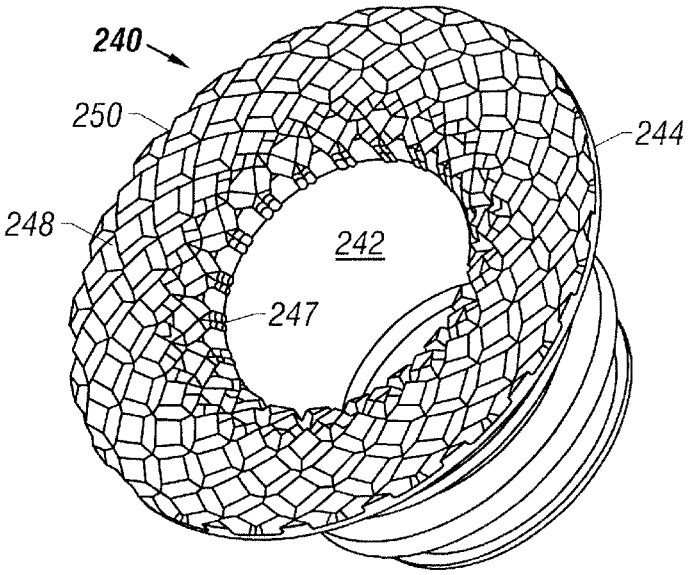
Figure 16A:
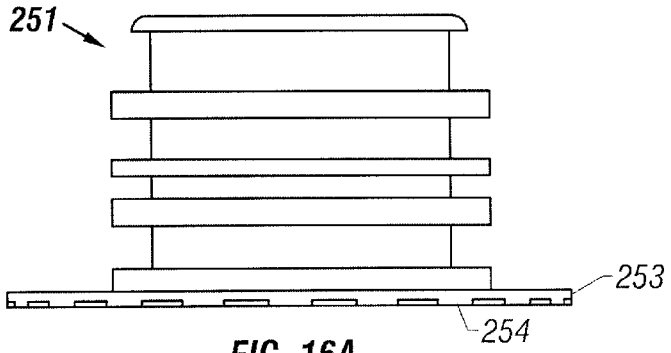
FIGS. 16*a*–16*c* are views illustrating an embodiment of a spout member having spiral grooves in accordance with the present invention.
Figure 16B:
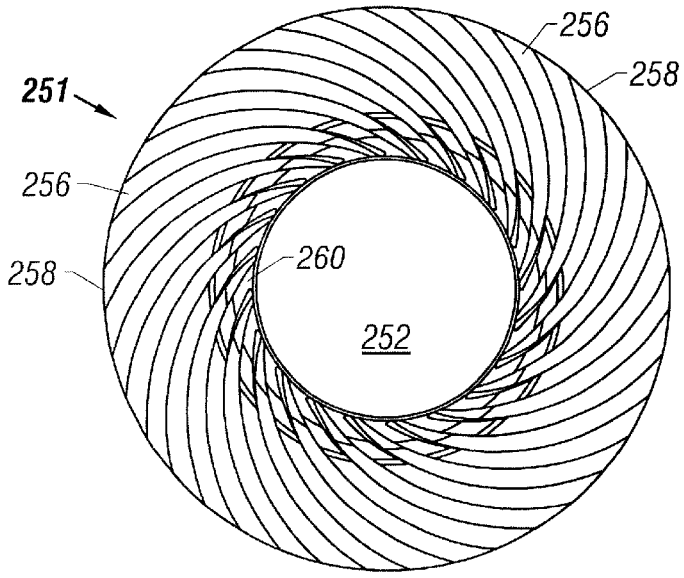
Figure 16C:
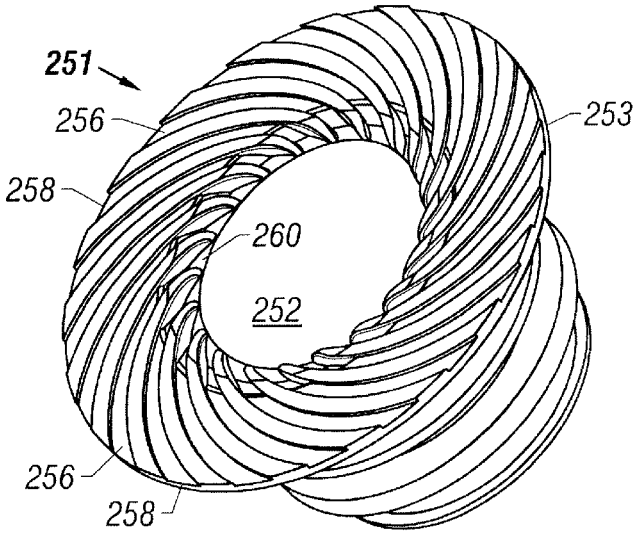

FIGS. 15*a*–15*c*, 16*a*–16*c*, 17*a*–17*c*, 18*a*–18*c*, and 19*a*–19*c* show alternative embodiments of the spout member. Spout member 240 of FIGS. 15*a*–15*c* includes an aperture 242 extending therethrough and further includes a lower flange 244 having a bottom surface 246. Waffle textured grooves 248 are integrally molded or embossed on the bottom surface 246 of the lower flange 244 to provide liquid draining channels 250 which help prevent the bag 100 from being sucked into the spout member 240 and which promote complete drainage of the bag 100. A recessed circumferential portion 247 can further enhance the prevention of fluid blockage resulting from the sheet 108 forming a fluid blockage seal with the circumferential edge of the aperture 242. Spout member 251 of FIGS. 16*a*–16*c* includes an aperture 252 extending therethrough and a lower flange 253 having a bottom surface 254 of the lower flange 253 to provide liquid draining channels 258. A recessed circumferential portion 260 can further enhance the prevention of fluid blockage.

Figure 17A:
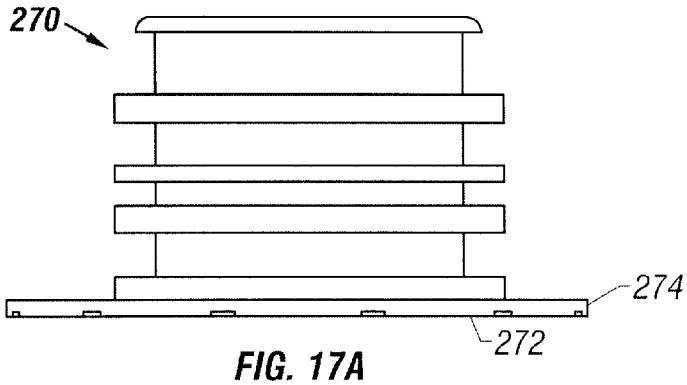
FIGS. 17*a*–17*c* are views illustrating an embodiment of a spout member having radial grooves in accordance with the present invention.
Figure 17B:
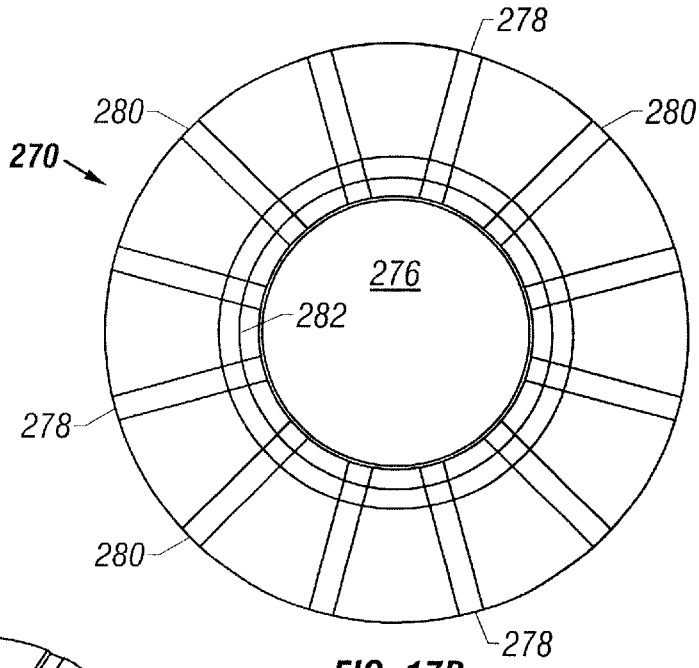
Figure 17C:
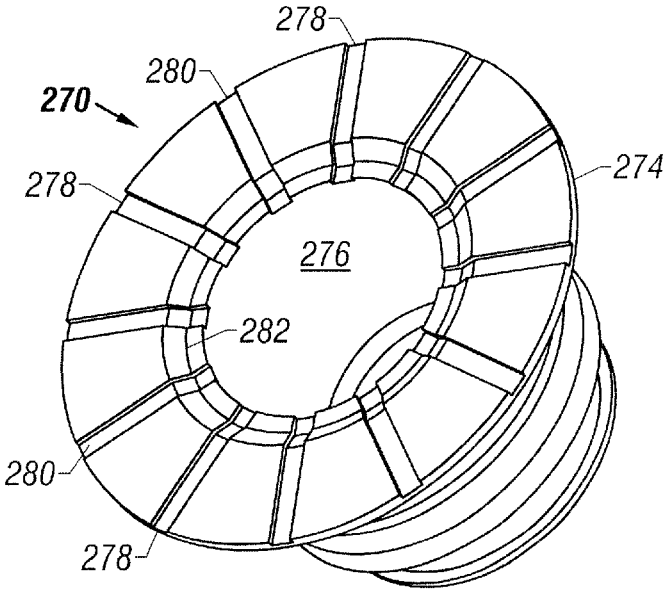

Spout member 270 of FIGS. 17*a*–17*c* is similar to the embodiment shown in FIG. 2 with the exception that a bottom surface 272 of a lower flange 274 does not include gussets and concentric ridges. An aperture 276 extends through the spout body member 270, and radial grooves 278 are integrally molded or embossed on the bottom surface 272 to provide liquid draining channels 280. A recessed circumferential portion 282 can further enhance the prevention of fluid blockage.

Figure 18A:
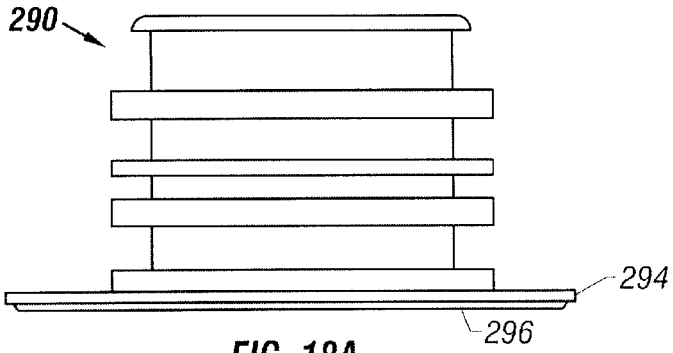
FIGS. 18*a*–18*c* are views illustrating an embodiment of a spout member having concentric ridges in accordance with the present invention.
Figure 18B:
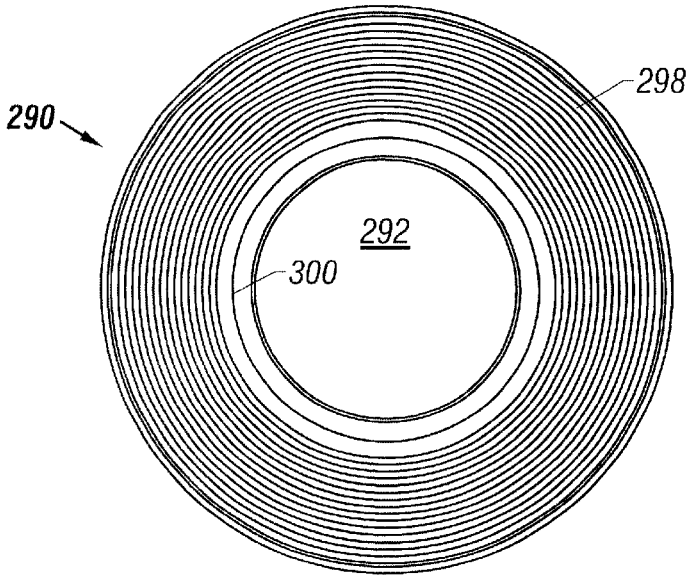
Figure 18C:
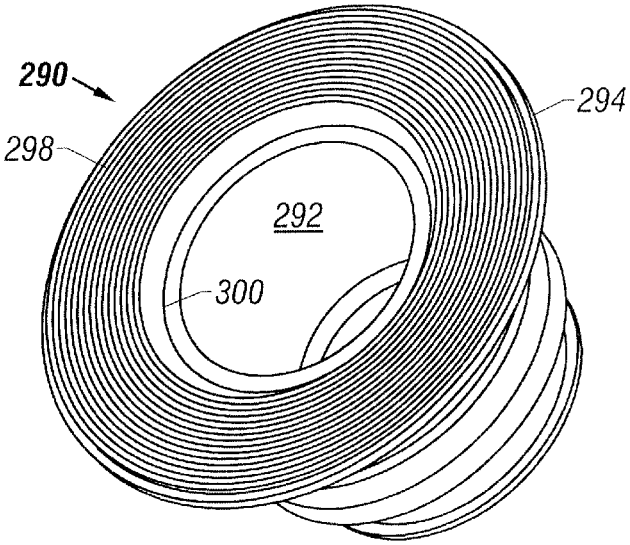

Spout body member 290 of FIGS. 18*a*–18*c* includes an aperture 292 extending therethrough and a lower flange 294 having a bottom surface 296. Concentric ridges 298 are integrally molded or embossed on the bottom surface 296 to provide liquid draining channels with the "textured" surface of the sheets 104, 108. A recessed circumferential portion 300 can further enhance the prevention of fluid blockage.

Figure 19A:
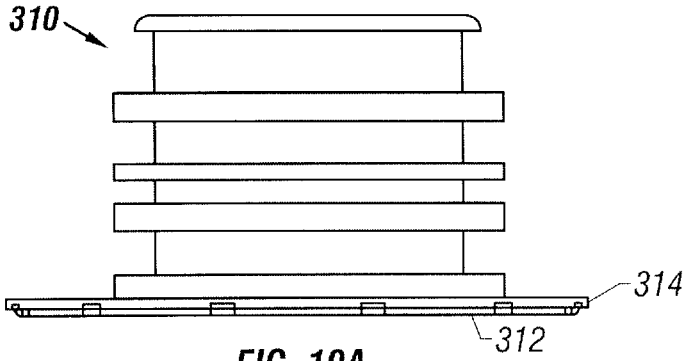
FIGS. 19*a*–19*c* are views illustrating an embodiment of a spout member having radial grooves and concentric ridges in accordance with the present invention.
Figure 19B:
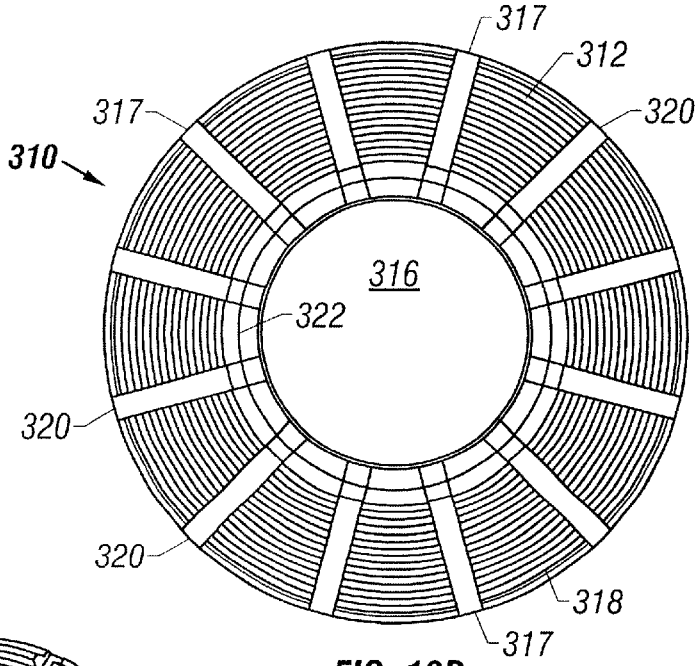
Figure 19C:
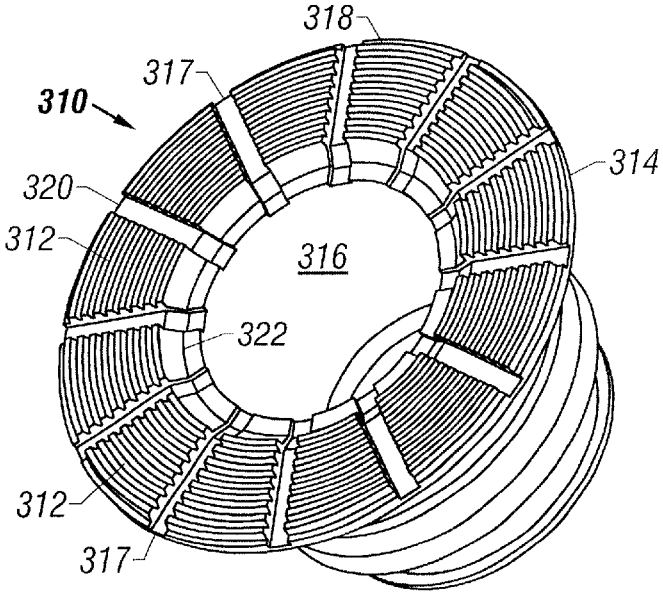

Spout member 310 of FIGS. 19*a*–19*c* is similar to the embodiment shown in FIG. 2 with the exception that a bottom surface 312 of a lower flange 314 does not include gussets. An aperture 316 extends through the spout member 310. Radial grooves 317 and concentric ridges 318 are integrally molded or embossed on the bottom surface 312 to provide liquid draining channels 320. A recessed circumferential portion 322 can further enhance the prevention of fluid blockage.

Figure 20A:
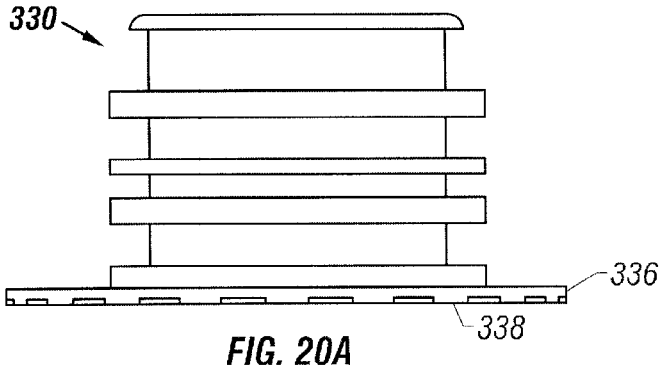
FIGS. 20*a*–20*c* are views illustrating an embodiment of a spout member having spiral grooves and partially extended cross-bars in accordance with the present invention.
Figure 20B:
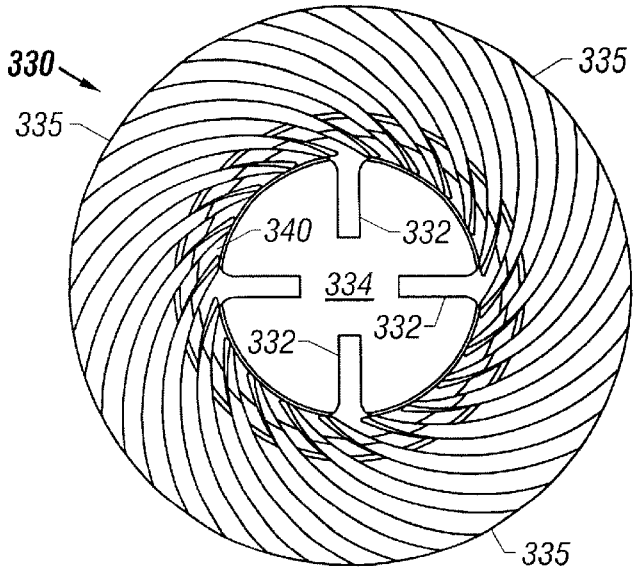
Figure 20C:
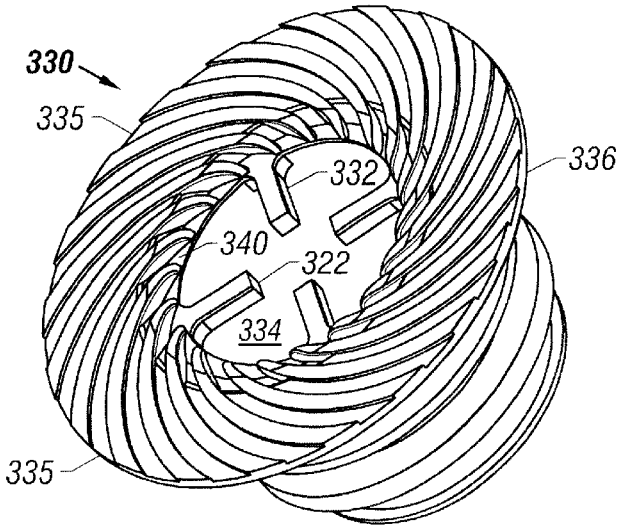
Figure 21A:
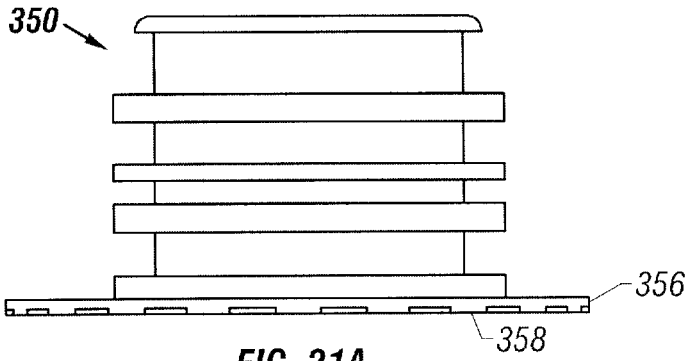
FIGS. 21*a*–21*c* are views illustrating an embodiment of a spout member having spiral grooves and fully extended cross-bars in accordance with the present invention.
Figure 21B:
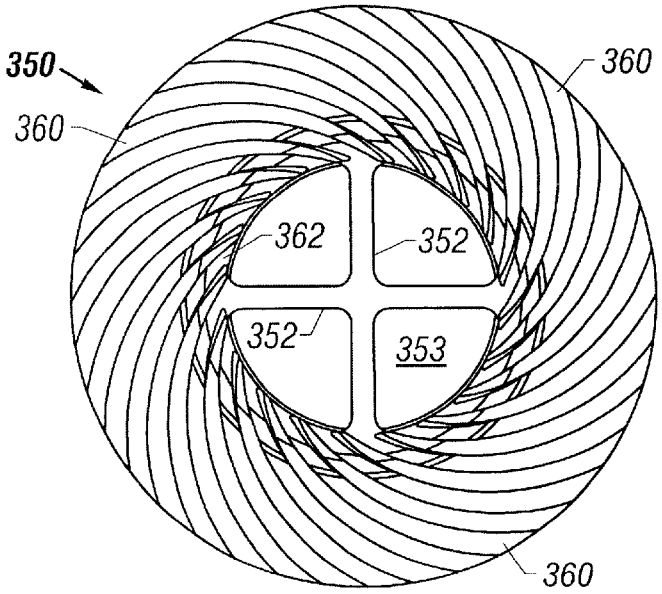
Figure 21C:
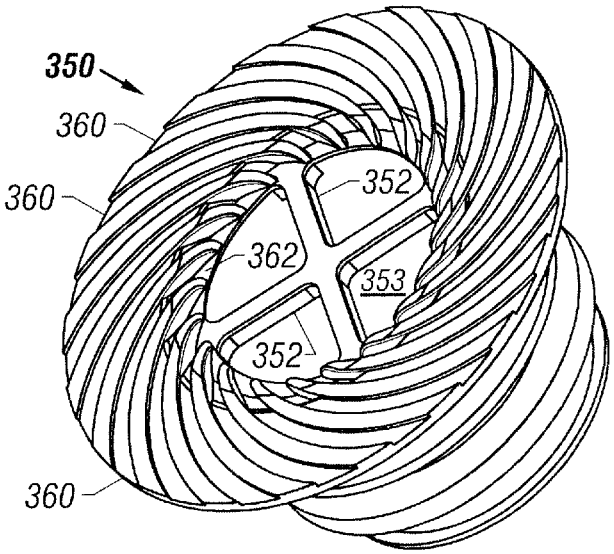

Additional embodiments of the spout member are shown in FIGS. 20*a*–20*c* and 21*a*–21*c*. Spout member 330 of FIGS. 20*a*–20*c* is similar to embodiment illustrated in FIGS. 16*a*–16*c* and further includes cross-bars 332 extending into an aperture 334 of the spout member 330. The cross-bars 332 are particularly applicable when relatively thin and flexible sheets 104, 108 are used, wherein the cross-bars 332 operate in conjunction with spiral grooves 335 to prevent the bag 100 from being sucked into the spout member 330. The spout member 330 further includes a lower flange 336, a bottom surface 338, and a recessed circumferential portion 340. Spout member 350 of FIGS. 21*a*–21*c* is similar to the embodiment illustrated in FIGS. 20*a*–20*c* with the exception that cross-bars 352 extend continuously from one sidewall of an aperture 353 to an opposing wide wall of the aperture 353. The spout member 350 includes a lower flange 356, a bottom surface 358, spiral grooves 360, and a recessed circumferential portion 362.

Figure 22A:
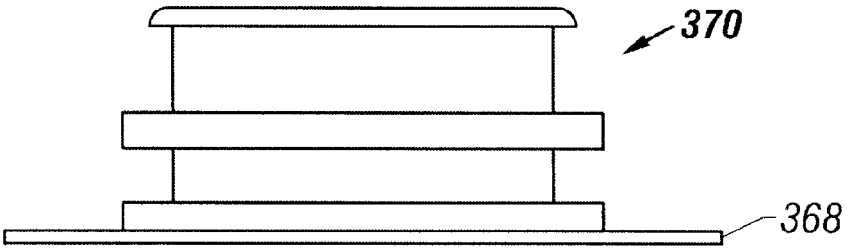
FIGS. 22*a*–22*c* are views illustrating an embodiment of a spout member with a separate channel member having radial grooves, concentric ridges, and gussets in accordance with the present invention.
Figure 22B:
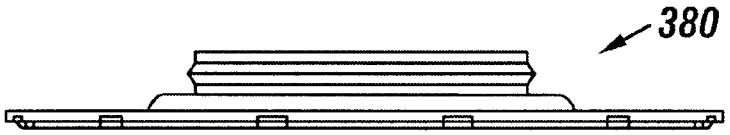
Figure 22C:
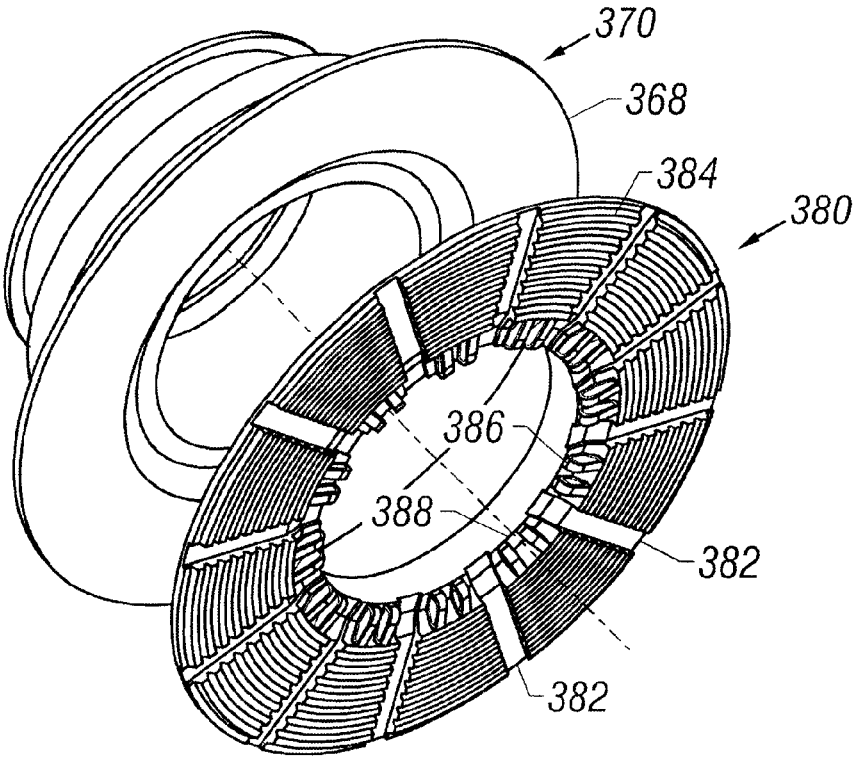
Figure 23A:
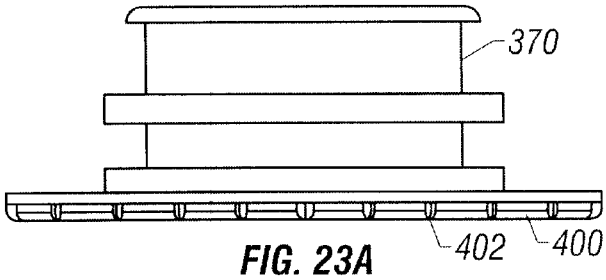
FIGS. 23*a*–23*c* are views illustrating an embodiment of a spout member with a separate channel member having radial grooves and cross-bars in accordance with the present invention.
Figure 23B:
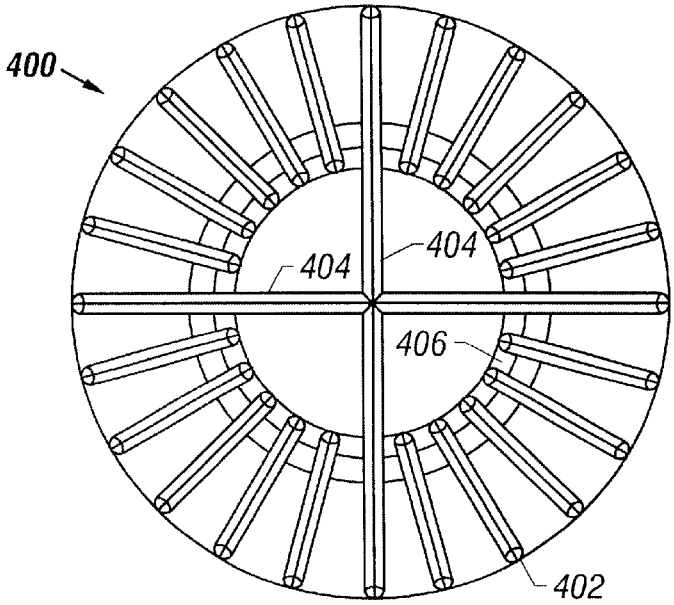
Figure 23C:
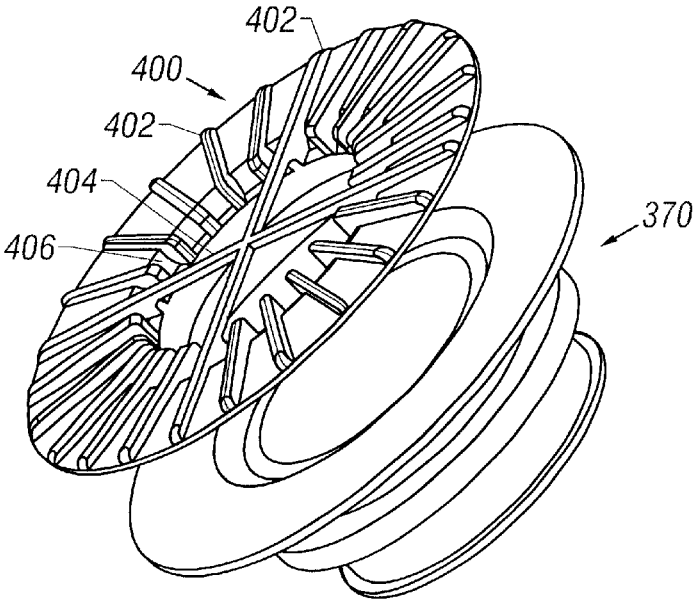
Figure 24A:
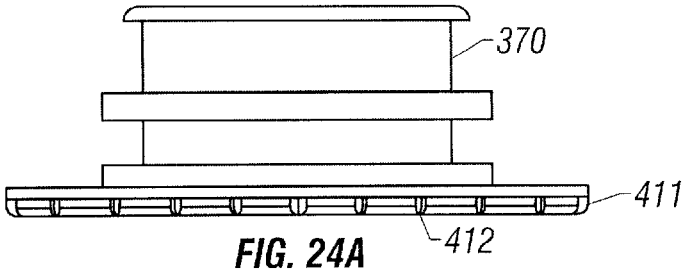
FIGS. 24*a*–24*c* are views illustrating an embodiment of a spout member with a separate channel member having radial ridges and cross-bars in accordance with the present invention.
Figure 24B:
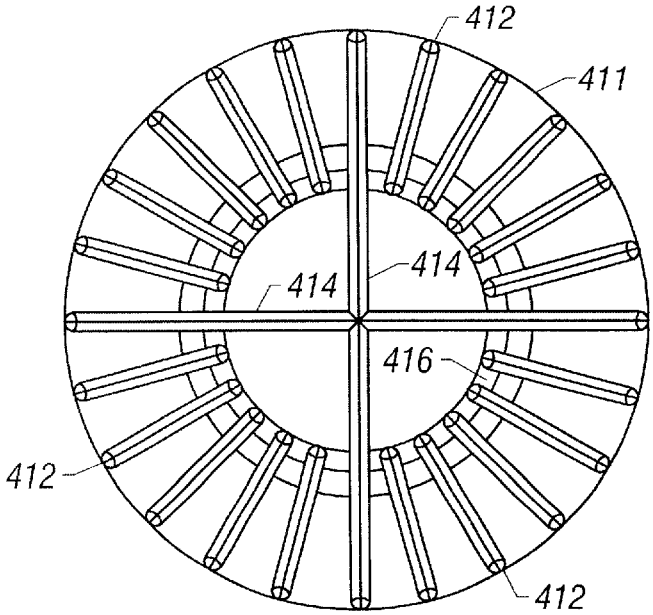
Figure 24C:
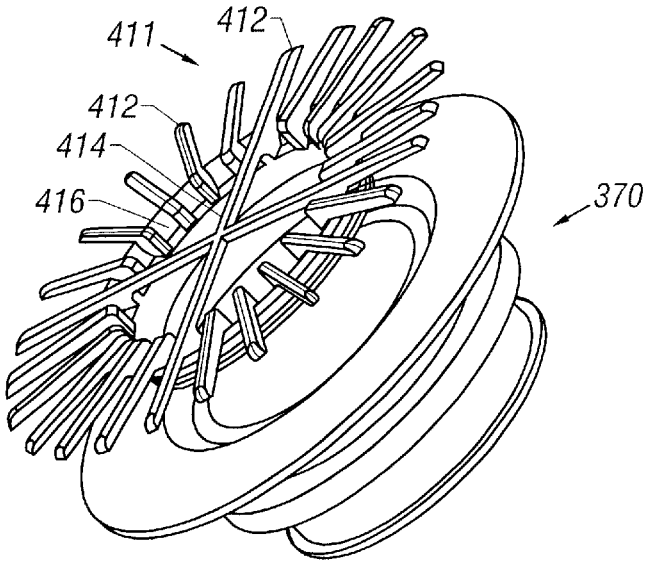
Figure 25A:
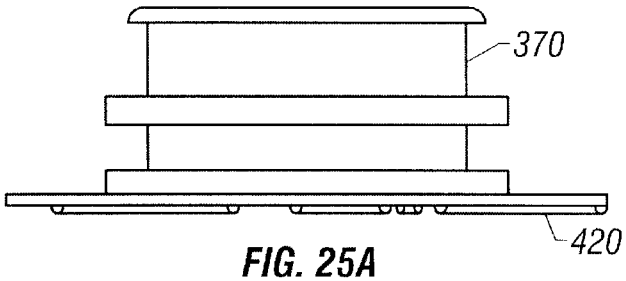
FIGS. 25*a*–25*c* are views illustrating an embodiment of a spout member with a separate channel member having radial ridges in accordance with the present invention.
Figure 25B:
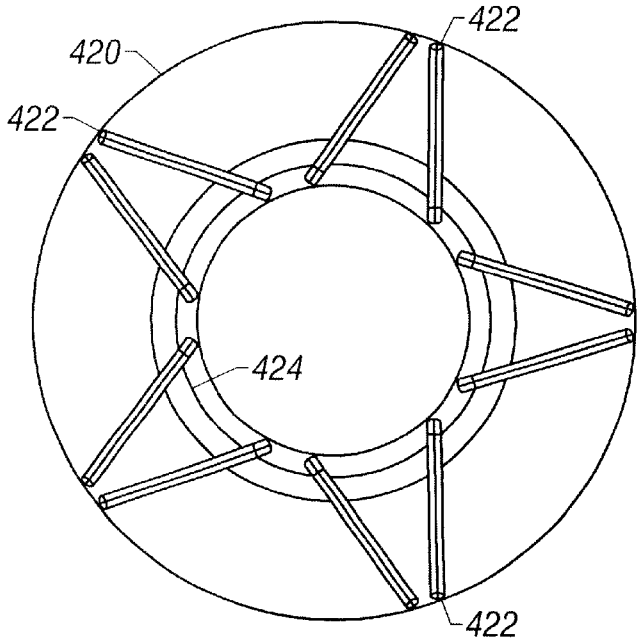
Figure 25C:
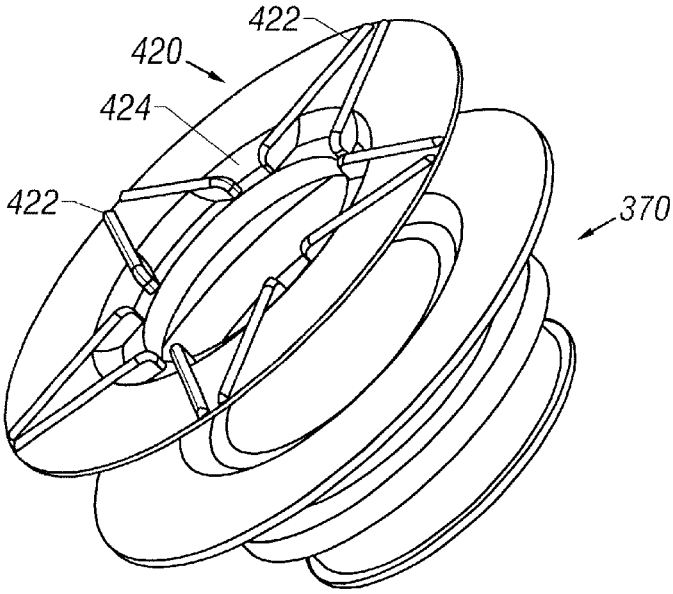
Figure 26A:
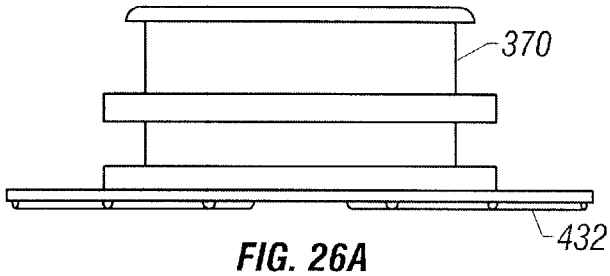
FIGS. 26*a*–26*c* are views illustrating an embodiment of a spout member with a separate channel member having radial ridges in accordance with the present invention.
Figure 26B:
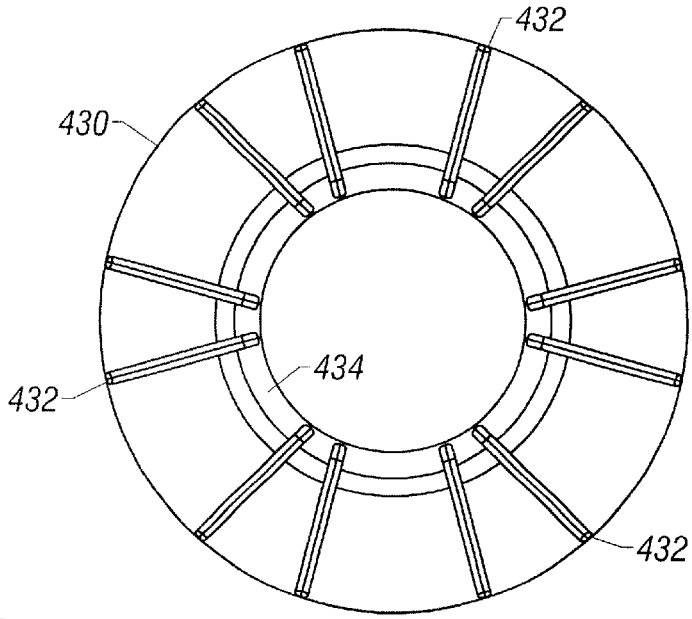
Figure 26C:
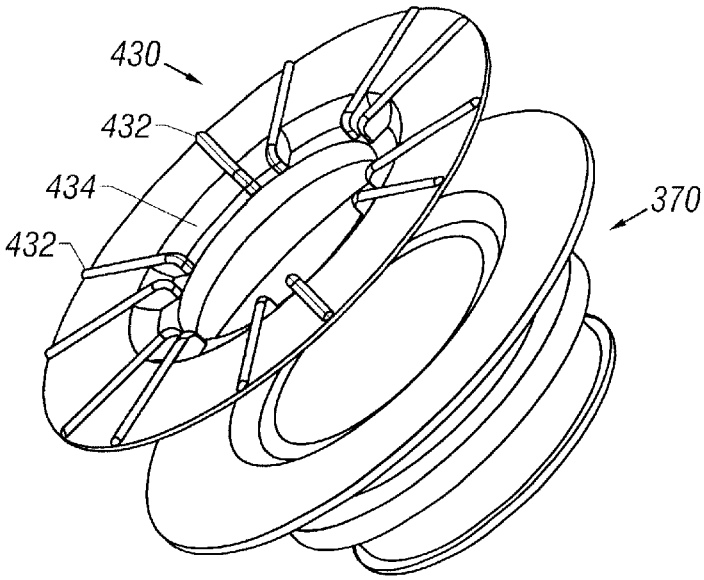

Still further additional embodiments of the spout member are shown in FIGS. 22*a*–22*c*, 23*a*–23*c*, 24*a*–24*c*, 25*a*–25*c*, and 26*a*–26*c*. The textured feature of a lower flange 368 may also be attained by attaching another piece to the spout member 370, wherein the added piece, when assembled to the spout member 370 creates ridges, grooves, or other patterns resulting in a texture that prevents the sheet form collapsing onto the lower flange 368 or being sucked into the spout member 370 opening. In these embodiments, the lower flange 368 which is adapted to accept a separate channeling member. The separate channeling member may be attached to the lower flange 368 by means of a pressure fit, snap fit, interference fit, heat seal, ultrasonic seal, adhesive, or any other method generally known to one skilled in the art. One of the advantages of providing such a configuration is that a generic spout member 370 may be used for various fluid applications to reduce manufacturing cost because the separate channeling members may be specifically tailored in accordance with the fluid dynamic qualities of the liquid product (i.e. viscosity) while utilizing the spout body member 370 for most applications. FIGS. 22*a*–22*c* illustrates the spout member 370 having a separate channeling member 380 with radial grooves 382, concentric ridges 384, gussets 386, and a circumferential recessed portion 388. FIGS. 23*a*–23*c* illustrates the spout member 370 having a separate channeling member 400 with radial grooves 402, cross-bars 404, and a circumferential recessed portion 406. FIGS. 24*a*–24*c* illustrates the spout member 370 with a separate channel member 411 having radial ridges 412, cross-bars 414, and a circumferential recessed portion 416. FIGS. 25*a*–25*c* illustrates the spout member 370 with a separate channeling member 420 having radial ridges 422 and a circumferential recessed portion 424. FIGS. 26*a*–26*c* illustrates the spout member 370 with a separate channeling member 430 having radial ridges 432 and a circumferential recessed portion 434.

Sheet Construction

The embossed sheet construction of FIG. 6, for example, can be formed in a mechanical embossing process, between two patterned (male-female) rollers. A variation of mechanical embossing uses one patterned roller and one rubber-coated roller between which the plastic film is fed to impart the pattern in the film. An alternative sheet construction is to form the sheet(s) using an ultrasonic embossing procedure. A bag formed using a mechanical embossed construction is shown in FIGS. 27*a* and 27*b* generally at 440.

Both sheets 104, 108 of the bag 440 are shown to have a mechanically embossed construction. Either mechanically or ultrasonically, the embossing would be on the interior surfaces of the sheets 104, 108 and can cover the entire sheet surface or only a central portion thereof (as illustrated in FIGS. 27*a* and 27*b*). For example, either ultrasonic or mechanical embossing allows the embossed surface pattern to be controlled, and a void 442 (FIG. 27*a*) can be provided around the spout 124 to allow the current spout seal process or remain unchanged. This can be advantageous if embossing changes its seal characteristics. Similarly, an alternative construction is to form only one sheet 104 or 108 with a mechanically or ultrasonically embossed surface.

Figure 28:
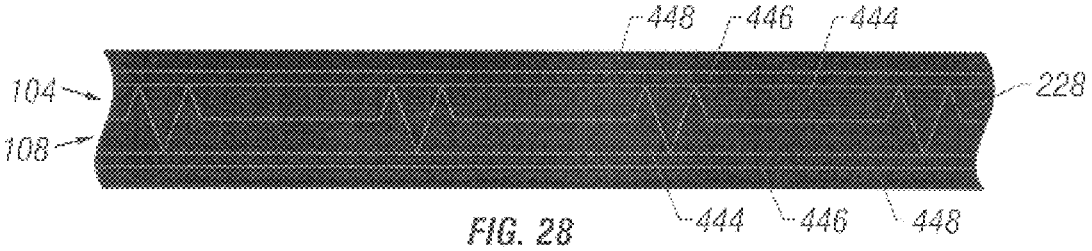
FIG. 28 is an enlarged cross-sectional view through a portion of an alternative ultrasonically-embossed bag in accordance with the present invention.
Figure 29:
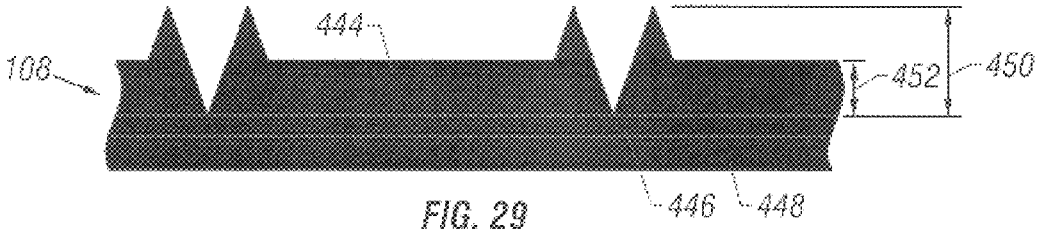
FIG. 29 is an enlarged view of an alternative three-layer, ultrasonically-embossed bag sheet in accordance with the present invention.

As shown in FIG. 28, the sheets 104, 108 can have a multiple-layer laminated construction, which has polyethylene-nylon-polyethylene layers 444, 446, 448 or simply polyethylene-nylon layers. Referring to FIG. 29, the thickness dimensions 450, 452 can be 0.015 and 0.003 inch, respectively, in a 2:1 ratio. Other sheet constructions can include layers of low density polyethylene-medium density polyethylene-low density polyethylene-nylon-low density polyethylene; the medium density polyethylene adding stiffness. In contrast, the standard embossing of FIG. 6 preferably has a 3:1 ratio. Also, ratios higher than 2:1 can be used with appropriately designed embossing roller/sonic horn combinations.

Figure 27A:
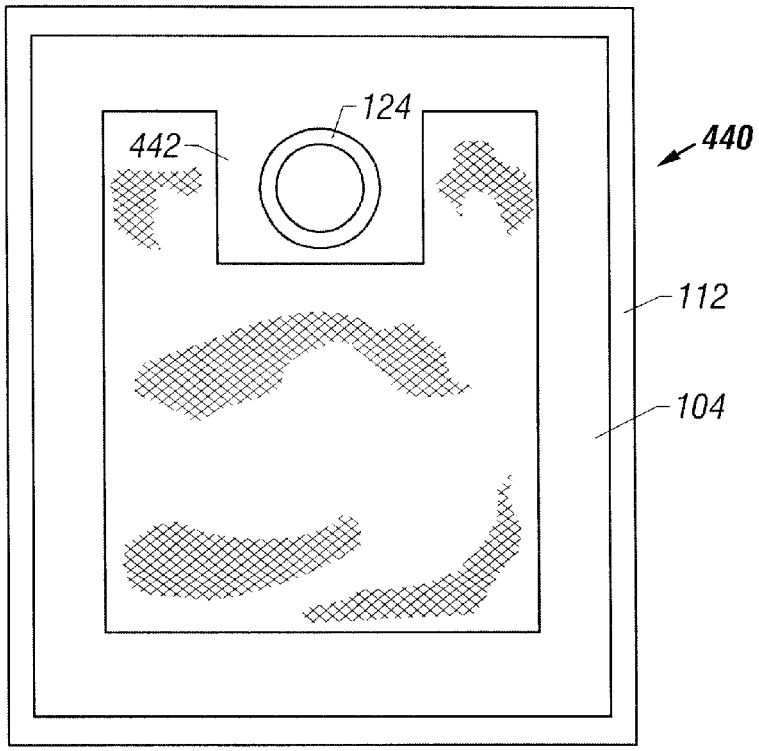
FIG. 27*a* is a top plan view of an alternative collapsible bag of the present invention wherein substantial portions of the top and bottom sheets are mechanically embossed.
Figure 27B:
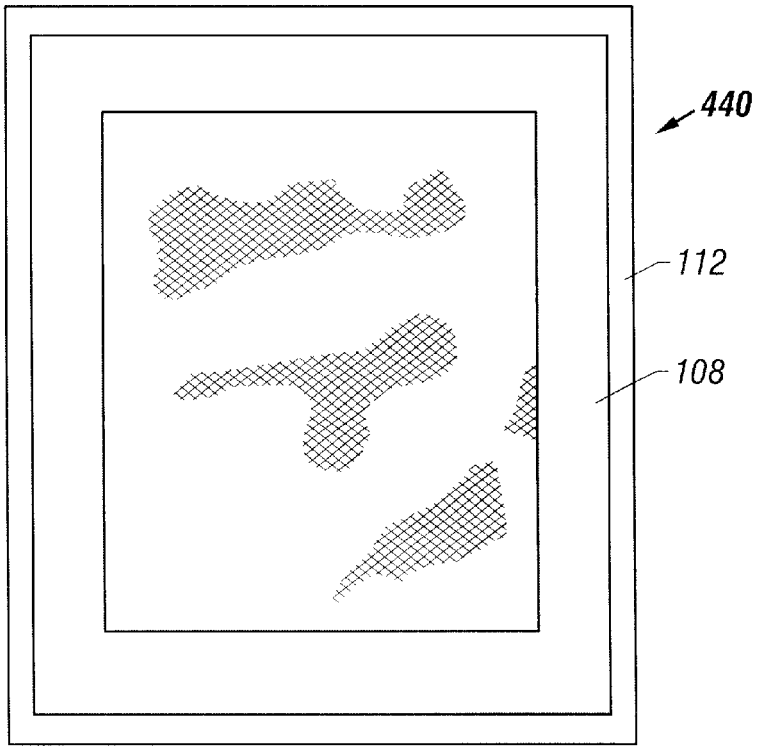
FIG. 27*b* is a bottom plan view of the bag of FIG. 27*a;*
Figure 30:
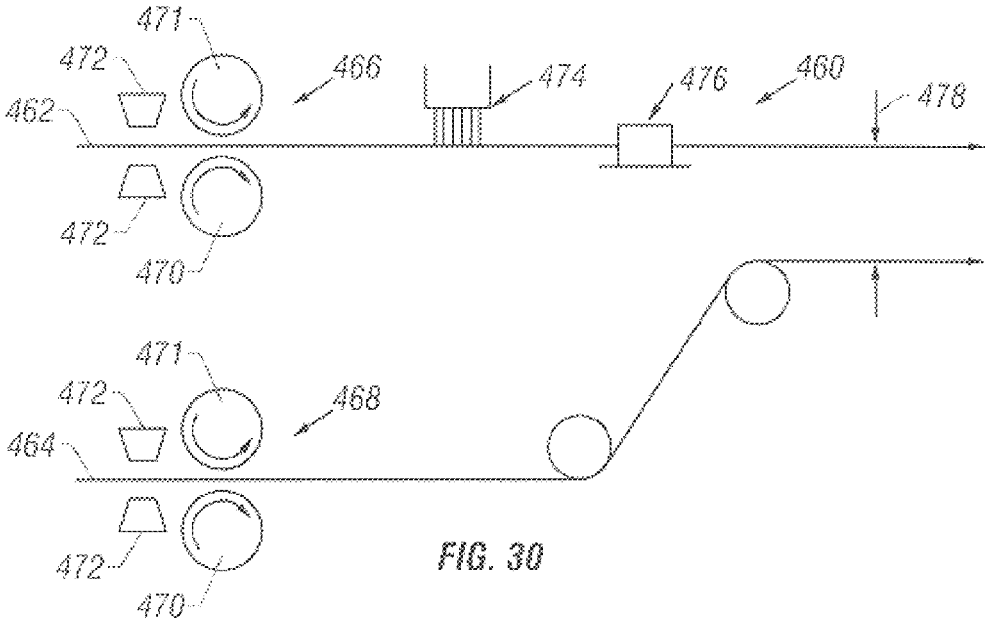
FIG. 30 is a simplified schematic view showing a process for manufacturing the bag of FIG. 27*a* in accordance with the present invention.

A system for manufacturing the bag of FIGS. 27*a* and 27*b* is illustrated schematically in FIG. 30 generally at 460. Webs 462, 464 of the top and bottom (single or multi-layer) sheets 104, 108 are shown entering the system 460 at the left of the drawing. Both enter mechanical embossing stations 466, 468 respectively, with their embossing rollers 470, 471 and heat sources 472 (e.g. UV and IR heat sources) just before the rollers 470, 471. The top sheet web 462 then enters hole-punching and spout-sealing stations 474, 476, respectively. The two sheets 104, 108 are then perimeter sealed together at the sealing station 478. The sealing can be heat sealing, ultrasonic sealing or RF sealing. Advantageously and unlike the earlier-described prior art bags, no separate dip strip or dip strip insertion equipment is needed to construct collapsible bag 440.

Mechanical embossing may be preferred over ultrasonically embossing because it produces a more pronounced and deeper pattern. Both are more adaptable to the current bag making process due to the ability to cycle (on-off). The advantage of ultrasonically embossed material (such as polyethylene laminated to nylon) is that capillary channels are created which are less susceptible to blockage due to the bag 100 folding over, vacuum, or direct pressure. In contrast, the channels formed by mechanically embossing can possibly be folded flat in the crease of the bag or at the spout. On the other hand, the mechanically-embossed operation advantageously has more capacities to offer deeper embossing effect.

Figure 31A:
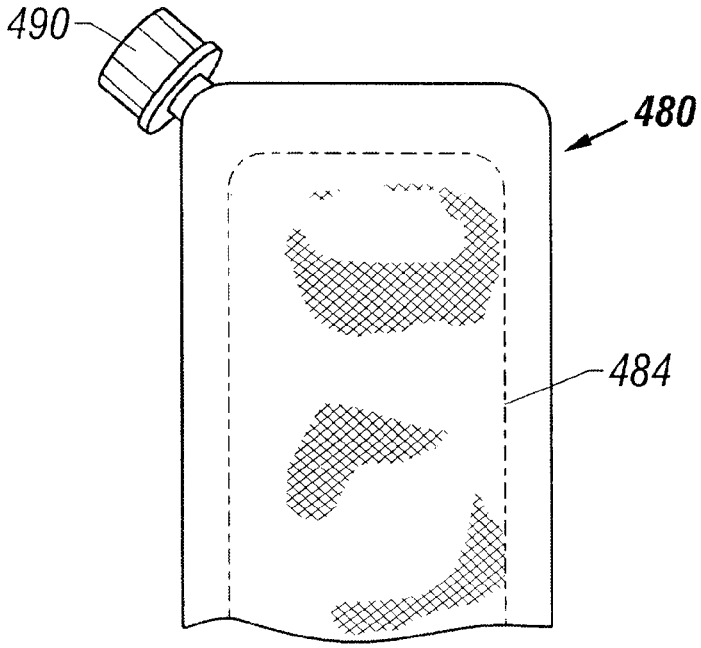
FIG. 31*a* is a side elevation (or top plan) view of an alternative collapsible bag of the present invention, commonly referred to as a stand-up pouch.
Figure 31B:
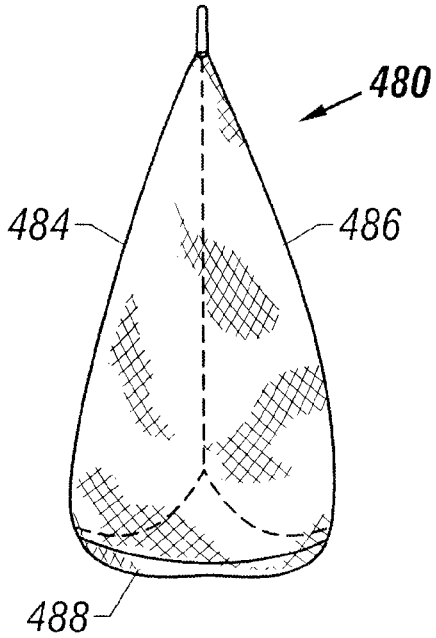
FIG. 31*b* is an end view of the bag of FIG. 31*a*.

Discussed above are collapsible bags formed from two sheets and having two walls. However, it is also within the scope of the present invention to form a bag such as that shown generally at 480 in FIGS. 31*a* and 31*b* with three walls usually formed from three sheets 484, 486, 488 and a capped spout or fitment 490. Any of the textured surfaces described previously can be provided on the internal surface of any one or two or all three of the sheets 484, 486, 488. A four walled bag (having two gussets) is also within the scope of the invention.

Figure 33A:
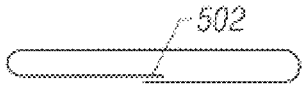
FIGS. 32*a*, 32*b*, 32*c* and 32*d* and FIGS. 33*a*, 33*b*, 33*c* and 33*d* show four different sealing arrangements of a bag formed from a single web of film of the present invention.
Figure 33B:
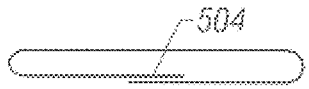
Figure 32A:
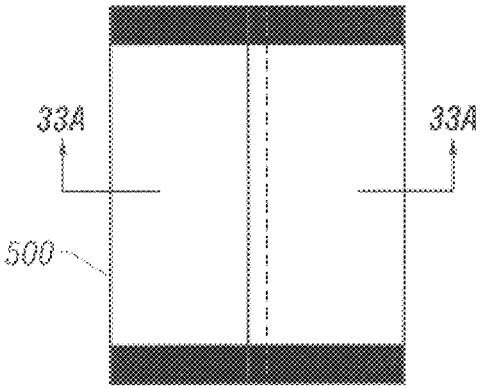
Figure 32B:
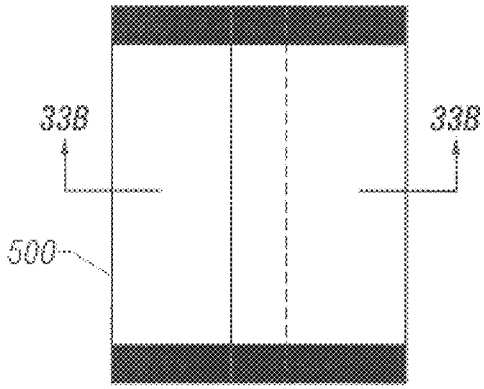
Figure 33C:
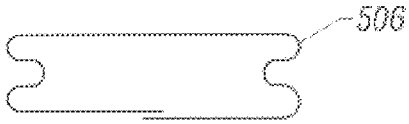
Figure 33D:
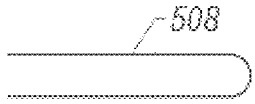
Figure 32C:
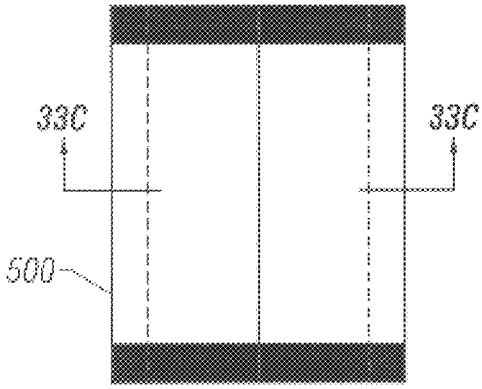
Figure 32D:
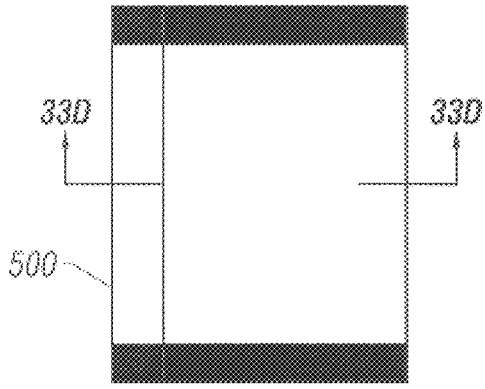

Alternatively, the ("textured surface") bag can be formed from a single sheet or web 500 as shown in FIGS. 32*a*–32*d*. And the panel can be secured to itself with a lap seal 502 as shown in FIG. 33*a*, a fin seal 504 as shown in FIG. 33*b*, a gusset seal 506 as shown in FIG. 33*c* or a three-sided seal 508 as shown in FIG. 33*d*. The bag can be formed in a form-fill-seal process as is known, such as is used for today's potato chip bags.

The present invention can be embodied in bags of generally any shape including mandrel, tray or pocket with lid and tetrahedron. Another construction of the invention would be for the two sheets to have different "textured" constructions; for example, one can have embossed and the other seal pleated, or one can have a folded and the other an embossed. A further design is for the bag to not have a built-in spout or fitment. Further, another design is for the bag to have a spout sealed into the perimeter seal of the bag. This is commonly referred to as a fin-sealed spout.

From the foregoing detailed description, it will be evident that there are a number of changes, adaptations and modifications of the present invention which come within the province of those skilled in the art. The invention includes any combination of the elements from the different species and/or embodiments disclosed herein. However, it is intended that all such variations not departing from the spirit of the invention be considered as within the scope thereof.

What is claimed is:

1. A method of withdrawing fluid from a container comprising:

providing a container comprised of single layer flexible walls, wherein the single layer flexible walls have a laminate construction;

urging fluid out of the container through a spout on said container;

allowing said flexible walls of said container to move inwardly during flow of said fluid through said spout; and, directing fluid towards said spout along fluid pathways pressed into the internal surfaces of said flexible walls of said container, wherein the fluid pathways on opposing internal surfaces do not interlock.

2. A method as set forth in claim 1, further comprising continuing to direct fluid towards said spout along said fluid pathways at a time when said internal surfaces come into contact with said spout.

3. A method as set forth in claim 1, further comprising directing said fluid through said spout along fluid pathways distributed on internal surfaces of said spout.

4. A method as set forth in claim 3, further comprising continuing to direct fluid through said spout along said fluid pathways pressed into the internal surfaces of said flexible walls of said container at a time when said internal surfaces of said flexible walls come into contact with said spout.

5. A method as set forth in claim 3, wherein said fluid pathways on said internal surfaces of said spout are radial grooves.

6. A method as set forth in claim 1, wherein said fluid pathways are configured in a waffle pattern distributed on said internal surfaces of said flexible walls.

7. A method of withdrawing fluid from a container comprising:

urging fluid out of the container through a spout on said container;

allowing flexible, multi-ply walls of said container to move inwardly during flow of said fluid through said spout; and, continuing the urging of fluid out of the container when said flexible, multiply walls of said container collapse together, but do not interlock, by directing fluid towards said spout along embossed fluid pathways located below the internal surfaces of said flexible walls of said container.

* * * * *